US007665463B2

(12) United States Patent
Grauke

(10) Patent No.: US 7,665,463 B2
(45) Date of Patent: Feb. 23, 2010

(54) LARGE ANIMAL HYPERBARIC OXYGEN CHAMBER

(75) Inventor: Rob Grauke, Houston, TX (US)

(73) Assignee: Equine Oxygen Therapy Acquisitions, Versailles, KY (US)

( * ) Notice: Subject to any disclaimer, the term of this patent is extended or adjusted under 35 U.S.C. 154(b) by 715 days.

(21) Appl. No.: 11/346,455

(22) Filed: Feb. 2, 2006

(65) Prior Publication Data

US 2007/0175475 A1 Aug. 2, 2007

(51) Int. Cl.
*A61G 10/00* (2006.01)
*A62B 31/00* (2006.01)

(52) U.S. Cl. ..... 128/205.26; 128/202.12; 49/154; 49/253; 49/246; 49/339

(58) Field of Classification Search ..... 128/205.26, 128/202.12; 49/253, 154, 246, 247, 340, 49/339

See application file for complete search history.

(56) References Cited

U.S. PATENT DOCUMENTS

| | | | | | |
|---|---|---|---|---|---|
| 2,448,546 | A | | 9/1948 | Plemel et al. | |
| 3,489,109 | A | * | 1/1970 | Flowers, Jr. | 110/213 |
| 4,094,160 | A | | 6/1978 | Galerne | |
| 4,885,659 | A | * | 12/1989 | Nowell et al. | 361/212 |
| 5,327,904 | A | | 7/1994 | Hannum | |
| 5,685,293 | A | | 11/1997 | Watt | |
| 5,927,016 | A | * | 7/1999 | Borgen | 49/346 |
| 5,967,216 | A | * | 10/1999 | Mancini | 160/209 |
| 6,347,628 | B1 | * | 2/2002 | Maison | 128/202.12 |
| 6,352,078 | B1 | | 3/2002 | Harvey et al. | |
| 6,412,221 | B1 | * | 7/2002 | Emsbo | 49/154 |
| 6,443,148 | B1 | * | 9/2002 | Rodocker | 128/202.12 |
| 6,565,624 | B2 | | 5/2003 | Kutt et al. | |
| 6,857,536 | B2 | | 2/2005 | Smith | |
| 2002/0144683 | A1 | * | 10/2002 | Gurnee et al. | 128/205.24 |
| 2004/0079040 | A1 | * | 4/2004 | MacLean et al. | 52/302.1 |
| 2004/0255945 | A1 | | 12/2004 | Cheng | |
| 2004/0261796 | A1 | * | 12/2004 | Butler | 128/205.26 |
| 2005/0161039 | A1 | | 7/2005 | Gurnee et al. | |
| 2005/0166812 | A1 | | 8/2005 | Noll et al. | |
| 2005/0178387 | A1 | | 8/2005 | Gurnee et al. | |
| 2006/0169284 | A1 | * | 8/2006 | Meyer et al. | 128/205.26 |
| 2008/0006272 | A1 | * | 1/2008 | Lewis | 128/205.26 |

OTHER PUBLICATIONS

Equineox Technologies, 2004, www.equineox.com.

* cited by examiner

*Primary Examiner*—Justine R Yu
*Assistant Examiner*—Colin Stuart
(74) *Attorney, Agent, or Firm*—Carrie Boone; Carrie A Boone, P.C.

(57) ABSTRACT

A hyperbaric oxygen chamber for treatment of large animals such as horses is disclosed. The chamber is large enough for a horse to fit inside and comfortably move around. A specially designed davit door, though quite heavy, is easily manipulated and may be used to corral the horse during ingress or egress, and is serviceable using fluorocarbon lubricants. The door, sidewalls, and floor of the hyperbaric chamber are coated with a static dissipative polyurethane material suitable for oxygen environments and may protect the horse from injury and prevent sparks. The flooring is specially designed to allow the horse to eliminate during treatment, and may be cleaned easily and thoroughly without disassembly. The control mechanisms of the hyperbaric chamber include electro-pneumatic controls, for avoiding a fire hazard.

28 Claims, 23 Drawing Sheets front view right side view left side view cross-sectional view
with door open cross sectional view cross sectional view
with door closed

LARGE ANIMAL HYPERBARIC OXYGEN CHAMBER

FIELD OF THE INVENTION

This invention relates to hyperbaric oxygen treatment and, more particularly, to the special needs of large animals for which hyperbaric oxygen therapy is sought.

BACKGROUND OF THE INVENTION

Hyperbaric oxygenation, or hyperbaric oxygen therapy, is a treatment in which an individual is exposed to an environment of increased oxygen at ambient pressure greater than one atmosphere for a predetermined period of time. Hyperbaric oxygen therapy has been approved to treat many conditions, including embolisms, carbon monoxide poisoning, crush injuries, decompression sickness, anemia, and bone infections.

Hyperbaric oxygen therapy involves the application of oxygen (a gas) under pressure. Normal atmospheric pressure exerts approximately 14.7 pounds per square inch (psi), or 760 millimeters of mercury (mm Hg) on skin and on the air that is breathed. This atmospheric air is approximately 79% nitrogen and 21% oxygen, resulting in an oxygen pressure of about 160 mm Hg.

Dalton's law states that the component gas exerts a pressure equivalent to its percentage composition of the mixture. Hyperbaric oxygen therapy is generally discussed using atmospheres absolute (ATA). Normal atmospheric pressure at sea level of 14.7 psi, or 760 mm Hg, is equal to 1 ATA. When diving underwater, water pressure increases by 1 ATA for every 33 feet in depth. Therefore, at 33 feet underwater, an individual will experience 2 ATA of pressure, one ATA from normal atmospheric pressure and one ATA from the addition of 33 feet of water. 2 ATA is equivalent to 29.4 psi.

Normal circumstances of oxygen delivery in the body are dependent on the proportion of oxygen in the air that we breathe, lung function, the amount of hemoglobin in the blood and the body's normal circulation processes (blood pressure). Under normal atmospheric pressure, hemoglobin is approximately 97% saturated with oxygen and there is a smaller amount of oxygen dissolved in the plasma. The hemoglobin molecule is the primary carrier of oxygen to the tissues under normal atmospheric circumstances.

Increasing the inspired oxygen does not improve oxygen delivery by the hemoglobin, and breathing 100% oxygen at normal atmospheric pressure increases the amount of oxygen dissolved in the plasma by a small amount. The amount of oxygen dissolved in the plasma is referred to as the partial pressure of oxygen ($pO_2$).

Between the atmosphere and the mitochondria in the cells is a complicated transport system, along which the partial pressure of oxygen is reduced; this determines the rate at which oxygen can be delivered to the tissues. The succession of diminishing $pO_2$ is called the "Oxygen Cascade." The oxygen cascade involves a successive decrease in the partial pressure of oxygen as blood flow leaves the lungs and progresses to the cellular level, such that the capillary level and even lower at the intracellular level.

A dramatic increase in the partial pressure of oxygen obtained in the gas breathed in during hyperbaric oxygen therapy has been calculated. A hyperbaric chamber at 2 ATA with 100% oxygen produces two times the 760 mm Hg, or 1,520 mm Hg of oxygen. Breathing air (21% oxygen or 160 mmHg oxygen per ATA) would result in an oxygen partial pressure of 320 mmHg. Hyperbaric oxygen therapy thus provides the ability to dramatically increase the inspired oxygen and thus the amount of dissolved oxygen in the plasma. Most therapeutic applications of HBOT involve 3 ATA (2,280 mmHg of oxygen) or less.

Hyperbaric oxygen therapy has been of particular benefit for treatment of bone infections. Increased diffusion of oxygen from the blood vessels, enhancement of neovascularization (angiogenesis), stimulation of collagen production to build new bone, improvement of blood flow by reduction of edema via vasoconstriction, enhancement of leukocyte ability to kill bacteria, and enhancement of delivery and activity of antibiotics are among the benefits that have resulted from hyperbaric oxygen therapy.

Although treatment of humans using hyperbaric oxygen therapy is known, the therapy may also be useful to healing large animals, such as horses. There exist many differences between horses and humans that make treatment of horses using hyperbaric chambers non-trivial. The horse may be less likely to willingly enter a hyperbaric chamber than a human. Once inside the chamber, the horse is going to continue normal biological functions, such as urinating and defecating, behaviors that are not expected from human subjects. Because the horse may be in the chamber for an extended period of time, the horse may want to drink water. The weight of the horse also complicates treatment. A horse may easily weigh fifteen hundred pounds or more. Getting an animal of such size into a chamber may be problematic for a treatment professional, such as a veterinarian. These non-trivial issues are not simply solved by enlarging a hyperbaric oxygen chamber designed for human use.

Thus, there is a need for a hyperbaric oxygen therapy chamber that may be used to treat large animals, such as horses.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein like reference numerals refer to like parts throughout the various views, unless otherwise specified.

DETAILED DESCRIPTION

In accordance with the embodiments described herein, a hyperbaric system is disclosed, with a chamber capable of holding oxygen at high pressure, for treatment of large animals, such as horses. The hyperbaric chamber is large enough for a horse to fit inside and comfortably move around. The door frame of the hyperbaric chamber is large enough for ingress and egress of the horse without risk of injury. A specially designed davit door, though quite heavy, may easily be manipulated into a variety of positions. The door may be used to corral the horse during ingress or egress. The moving parts of the davit door assembly may be maintained using fluorocarbon lubricants, so as to avoid fire hazards. The door, sidewalls, and floor of the hyperbaric chamber are coated with a static dissipative polyurethane material suitable for oxygen environments and may protect the horse from injury and prevent contact between the steel chamber body and the shoes on the horse's hooves, so that dangerous sparks are avoided. The flooring is specially designed to allow the horse to eliminate during treatment, and the floor may be cleaned easily and thoroughly without disassembly. The control system 202 of the hyperbaric chamber includes electro-pneumatic controls, also for avoidance of fire hazard.

In the following detailed description, reference is made to the accompanying drawings, which show by way of illustration specific embodiments in which the invention may be practiced. However, it is to be understood that other embodiments will become apparent to those of ordinary skill in the art upon reading this disclosure. The following detailed description is, therefore, not to be construed in a limiting sense, as the scope of the present invention is defined by the claims.

Figure 1:
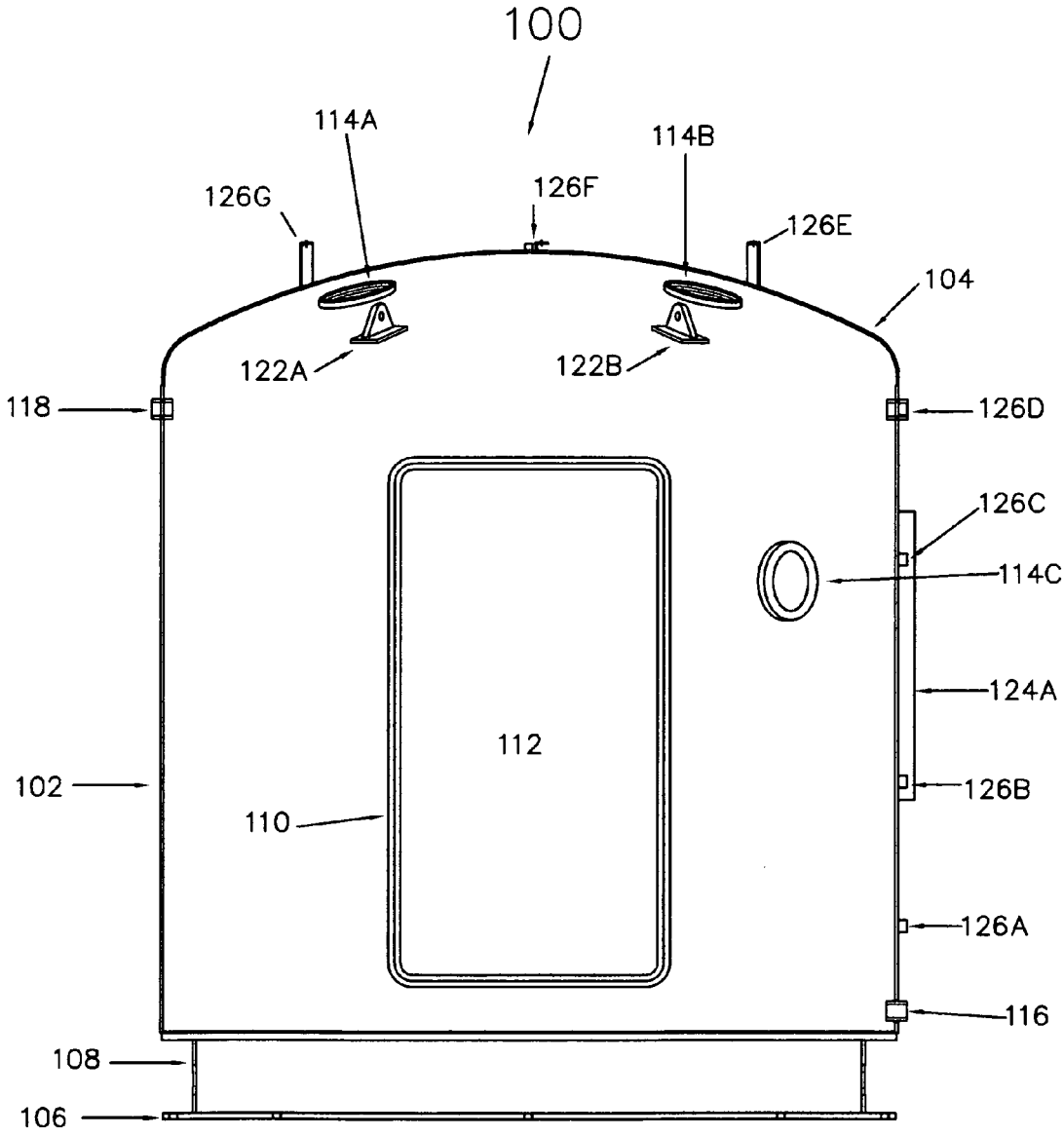
FIG. 1 is a front view of a hyperbaric chamber, according to some embodiments.
Figure 2:
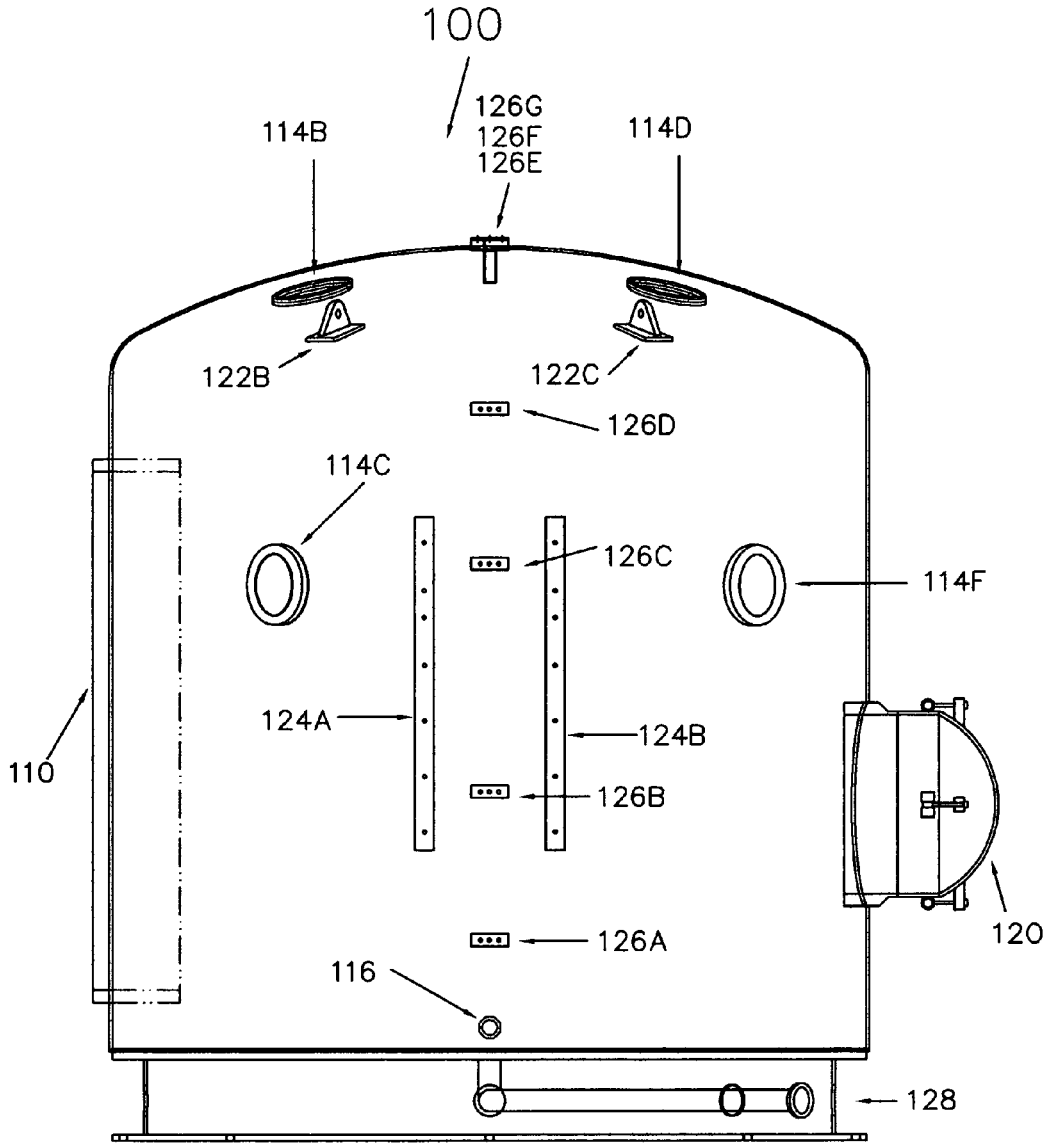
FIG. 2 is a right side view of the hyperbaric chamber of FIG. 1, according to some embodiments.
Figure 3:
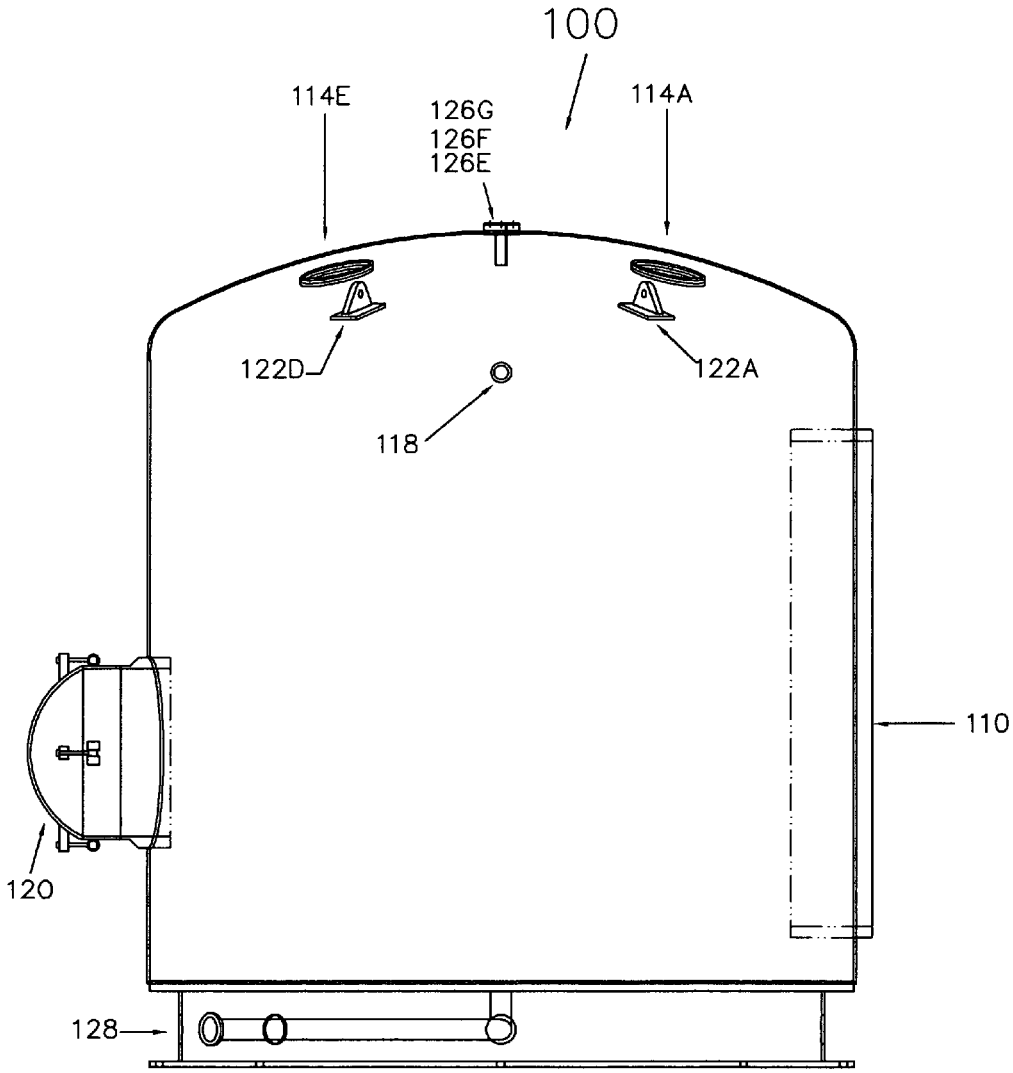
FIG. 3 is a left side view of the hyperbaric chamber of FIG. 1, according to some embodiments.

Referring to FIGS. 1-3, a hyperbaric system 100 is depicted, according to some embodiments, for providing hyperbaric oxygen therapy to large animals, such as horses. The hyperbaric system 100 includes a chamber or vessel 102, including a dished head 104. The chamber 102 is sufficiently large to comfortably and safely house the large animal so that the animal is ambulatory inside the chamber. In some embodiments, the chamber 102 is cylindrical in shape and the dished head 104 is domed. Curved surfaces are generally preferred over flat surfaces in pressurized environments.

Due to the volatile oxygen environment, the hyperbaric system 100 is installed in a controlled environment. This generally means that the chamber 102 is permanently affixed to a foundation structure, such as concrete within a building particularly so that ambient air surrounding the hyperbaric system 100 may be controlled. Accordingly, the bottom of the chamber 102 features a base plate 106 and a skirt 108. The base plate 106 may include holes through which bolts or other anchoring materials may be orthogonally disposed (not shown), for anchoring the base plate to a concrete or other suitable foundation surface. The horizontal dimension of the base plate 106 may be similar to that of the chamber 102, as shown. The skirt 108 is sufficiently thick in the vertical dimension to facilitate the disposition of drainpipes beneath the chamber 102 (not shown) and to mitigate corrosion. Preferably, the skirt 108 is recessed somewhat relative to the chamber 102 and base plate 106, so that the horizontal dimension of the skirt is slightly less than that the chamber 102.

The use of hyperbaric oxygen therapy for large animals, such as horses, presents special considerations not found in chambers for human use. For one thing, the horse will not be prevented from certain biological activities, such as urinating and defecating. Also, because the horse is being treated, sometimes for a serious illness or malady, steps are generally taken during treatment to make the horse as comfortable as possible. Thus, the horse may want to drink while standing in the hyperbaric chamber. (Typical treatment time may be fifty to seventy-five minutes.) Although the horse may typically enter the chamber without assistance, provisions for non-ambulatory horses are preferred. Also, because the horse may be under stress, due to the malady being treated or otherwise, providing a setting that is not too claustrophobic is preferred. The hyperbaric system 100 is designed with these considerations and more in mind.

A door frame 110 and door 112 are shown in FIG. 1. In FIGS. 2 and 3, side views of the door frame 110 are depicted, with the portion of the door frame disposed inside the chamber 102 being indicated with dashed lines. During operation of the hyperbaric system 100, the door 112 is sealed against the door frame 110, so that oxygen at a predetermined pressure may fill the chamber 102. The door 112 is preferably large enough to allow a large animal, such as a horse, to comfortably enter the chamber 102 with relative ease. Although the hyperbaric system 100 is designed with large animals in mind, its use is not limited to large animals, but may be used by other living entities, excluding humans. Hereinafter, the entity for which hyperbaric oxygen therapy is sought will be known as the subject. In some embodiments, the door 112 and door frame 110 are covered with protective materials designed to ensure that the subject is not hurt during ingress or egress. The door 112 is described in more detail in conjunction with the description of FIGS. 4-6, below.

In some embodiments, the chamber 102 is installed so that the base plate 106 and the skirt 108 are beneath the ground and the bottom of the chamber 102 is flush with the ground. This enables the horse to simply step through the door frame 112 and step onto a main floor 140, the floor being approximately level with the ground outside. (The floor assembly 138 is described in more detail in conjunction with FIGS. 8, 9, 10A, and 10B, below). The horse may step over the door frame 112, which, in some embodiments, is approximately twelve inches in depth and disposed two to three inches above the ground.

In some embodiments, the door frame 110 is twelve inches in depth, with approximately one-fourth of the door frame jutting outside the chamber 102, with the remaining three-fourths being inside the chamber 102, although the dimension and disposition of the door frame 110 may vary.

In some embodiments, the chamber 102, the dished head 104, the door 112, and the door frame 110 are composed of pressure vessel quality carbon steel material. In some embodiments, the material is SA 516 grade 70 plate. Further, the chamber 102, the dished head 104, the door 112, and the door frame 110 are covered with a three-coat epoxy paint system suitable for oxygen environments. The chamber 102 is ½-inch thick, in some embodiments, while the dish head 104 is ½-inch thick, plus or minus, in accordance with ASME specifications. Further, in some embodiments, the door frame 110 and door 112 are both two inches thick.

The chamber 102 features a number of portholes 114A-114F (collectively, port holes 114), arranged so that the subject within the chamber may be viewed, whether by human eyes or using an electronic device, such as a camera. In some embodiments, the portholes 114 may be affixed with cameras, to enable remote viewing of the large animal. Further, the cameras may be connected to a recording device for record-keeping and/or subsequent analysis of the chamber or the subject. Preferably, the portholes 114 are arranged strategically around the chamber 102. Portholes 114A, 114B, and 114C are in FIG. 1; portholes 114B, 114C, 114D, and 114F are in FIG. 2; portholes 114A and 114E are in FIG. 3.

When the subject enters the chamber 102, the air inside the chamber is identical to the ambient air. Once the subject is secure inside the chamber and the door is closed, the hyperbaric chamber is infused with oxygen and pressurized according to predetermined specifications. Accordingly, the hyperbaric system 100 features an inlet opening 116, for receiving the incoming oxygen, and an exhaust opening 118, for removing the ambient air. The inlet opening 116 is disposed at the bottom of the chamber 102 (FIGS. 1 and 2) while the exhaust opening 118 is disposed close to the top of the chamber (FIGS. 1 and 3). Alternately, these openings may be located in other regions of the chamber. The inlet opening 116 is disposed beneath flooring within the chamber; the flooring is described in more detail in FIG. 10A, below.

The chamber 102 also includes a man way 120, through which a human may enter the chamber. The man way 120 is not intended for routine ingress and egress, but for conditions in which entry into the chamber 102 is impaired, such as if the subject blocks the door 112, preventing entry. The chamber 102 is depressurized before use of the man way 120 is possible. The man way 120 may also be used to allow entry so that the door is secured to the chamber 102 prior to shipment of the hyperbaric system 100.

Also featured in the chamber 102 are lifting lugs 122A-122D (collectively, lifting lugs 122), secondary control box supports 124A-124B, and tube tray supports 126A-126D. The lifting lugs 122 enable the chamber 102 to be transported, such as for using a crane or other lifting device to position the chamber on the foundation. The secondary control box support 124A and 124B permit connection of a secondary control box 160 (not shown). The tube tray supports 126A-126G enable the pipes to be affixed to the outer sidewall of the chamber 102. The secondary control box 160, part of a control system 202, is discussed further in conjunction with FIG. 11, below.

Figure 4:
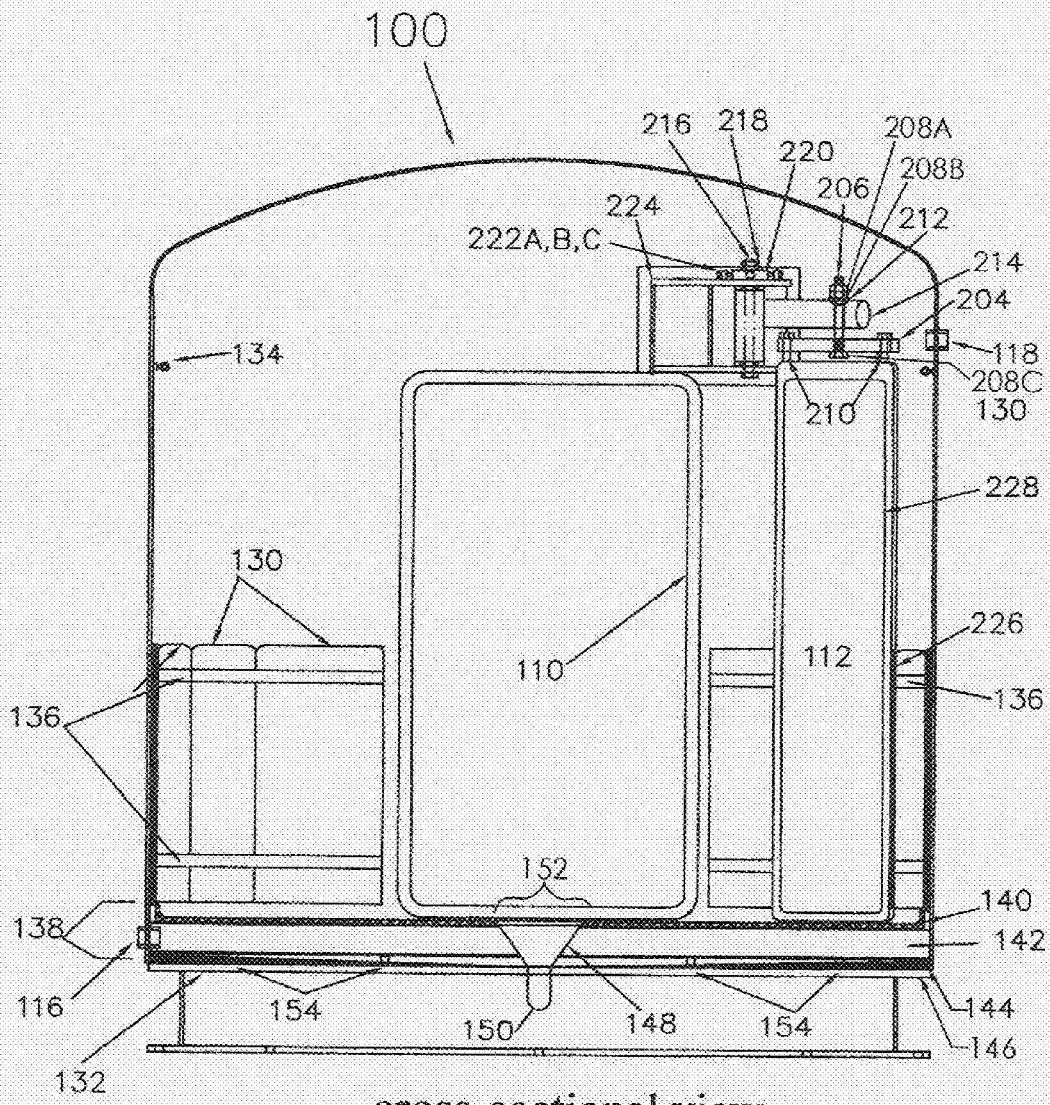
FIG. 4 is a cross-sectional view of the hyperbaric chamber of FIG. 1, including a davit door assembly, according to some embodiments.
Figure 5:
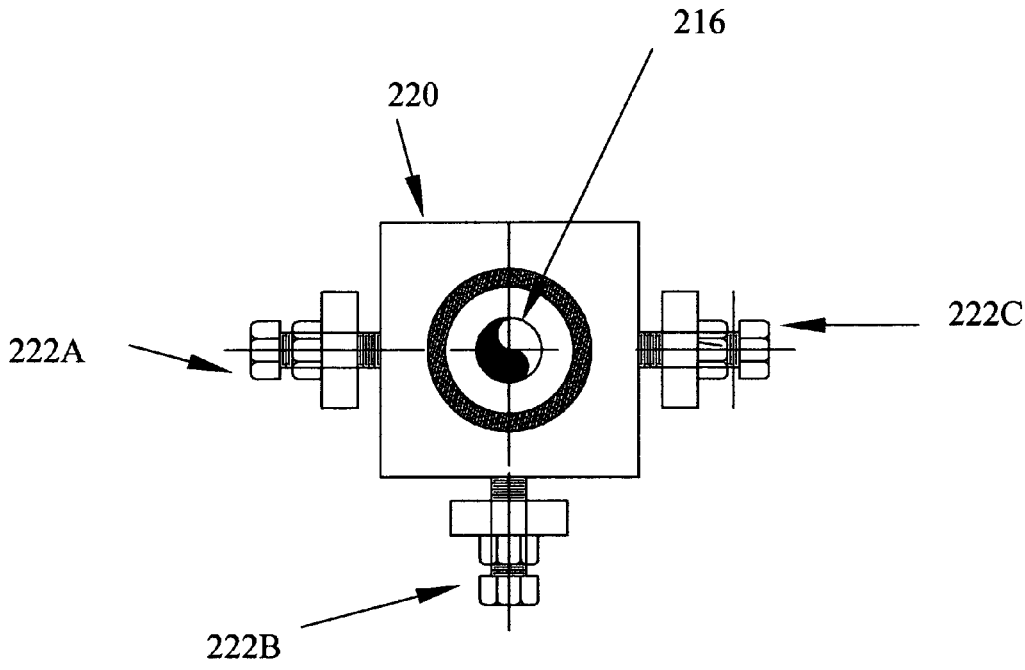
FIG. 5 is a diagram of the davit arm adjusting plate used in the davit door assembly of FIG. 4, according to some embodiments.
Figure 6:
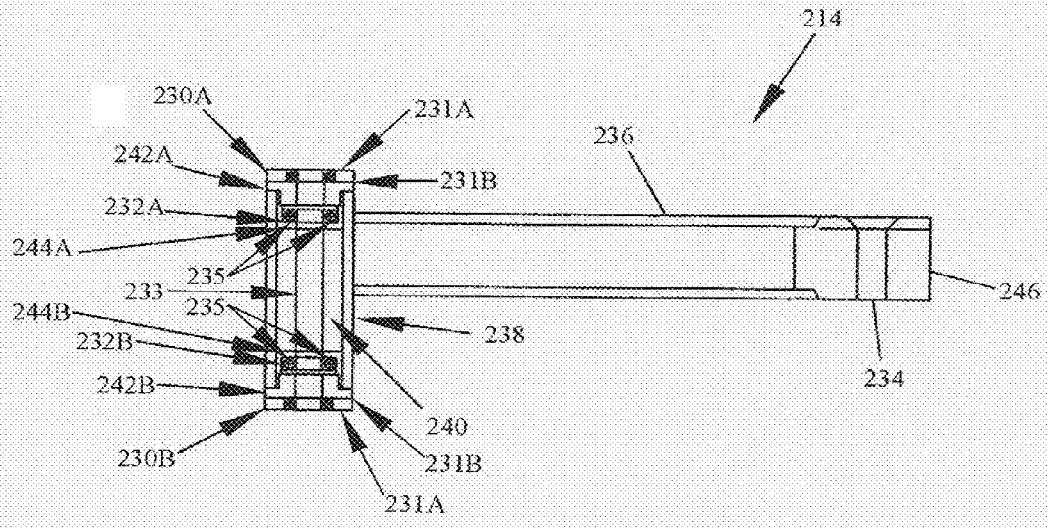
FIG. 6 is a cross-sectional diagram of the davit arm used in the davit door assembly of FIG. 4, according to some embodiments.

With reference to FIGS. 4-6, a davit door assembly 200 is depicted, according to some embodiments, for use in the chamber 102. The davit door assembly 200 includes the door 112 secured to an inner wall of the chamber 102 by a t-shaped davit arm 214. Because the door 112 is used to secure the hyperbaric chamber 102 so as to maintain a gas at high pressure, the door 112 tends to be heavy. In some embodiments, the door 112 weighs 2600 pounds. The davit arm 214 is rotatable so as to position the door 112 roughly against the inner wall of the chamber, such as during ingress and egress of the subject, and to secure the door 112 against the door frame 110 prior to use. In some embodiments, the davit arm 214 is capable of swinging in a 160° arc between the door frame 110 and the inner wall of the chamber 102. Further, the swivel shaft 206 may be rotated such that the door 112 revolves in a 360° circle. This is shown in the overhead view of the davit door assembly in FIG. 7.

In some embodiments, the davit door assembly 200 is made using materials designed according to ASME standards. (ASME, The American Society of Mechanical Engineers, sets internationally recognized industrial and manufacturing codes and standards that enhance public safety.) The components of the davit door assembly 200 are formed using pressure vessel quality carbon steel pipe and/or pressure vessel quality stainless steel. For each component that is composed of carbon steel, epoxy paint is applied to the surface to eliminate or minimize oxidation or rust.

The davit arm 214 is affixed to the wall of the chamber by threading a main davit arm shaft 216 through a davit arm support box 224, and securing the shaft 216 with a nut 218. The davit arm support box 224 is welded to the inside wall of the chamber 102, adjacent to the door frame 110.

A swivel shaft 206 is threaded orthogonally through a distal end of the davit arm 214, then threads orthogonally through a spreader bar 204, which is positioned between the davit arm 214 and the door 112. Locking nuts 208A and 208B are disposed atop the davit arm 214, along with a swivel washer 212, while a third locking nut 208C is disposed beneath the spreader bar 204. In some embodiments, the bottom locking nut 208C has a drilled hole through which a cotter pin is disposed (not shown). This keeps the locking nut 280C from turning on its threads.

Two door level adjusting bolts 210A and 210B (collectively, door level adjusting bolts 210) are also threaded orthogonally through the two ends of the spreader bar 204. The door level adjusting bolts 210, which support the door, are not threaded through the davit arm 214, but through the door 112. As the name suggests, the door level adjusting bolts 210 are used to level or otherwise adjust the door, such as following delivery. The bolts 210 may also be adjusted to ensure that the door 112 is centered against the door frame 110.

Above the davit arm support box 224, the main davit arm shaft is threaded through a davit arm adjusting plate 220. An overhead view of the davit arm adjusting plate 220 is featured in FIG. 5. The davit arm adjusting plate 220 includes three adjusting bolts 222A-222C. The assembly 200 shown in FIG. 5 enables a technician to easily adjust the davit door following delivery so that the door 112 moves as intended and is properly positioned against the door frame 110.

A door cover panel 226 is shown covering the bottom portion of the door 112. The door cover panel 226 protects the subject from injury. The chamber 102 also includes wall cover panels 130 to protect against injury. The door cover panel 226 and the wall cover panels 130 consist of specially formulated, anti-dissipative, polyurethane, soft molded pads to keep the subject from being injured against the hard steel of the chamber 102 and the door 112. Further, where the subject is a horse, by coating the steel with the anti-dissipative covering, the shoed hooves of the horse do not come in contact with the steel of the chamber 102, preventing sparks from accidentally occurring. In some embodiments, the chamber 102 includes eight wall cover panels 130 disposed around the entire chamber.

A cross-sectional view of the davit arm 214 is featured in FIG. 6. The davit arm 214 includes a horizontal member 236 and a vertical member 238. The main davit arm shaft 216 is threaded through a main davit arm shaft cavity 240 in the vertical member 238. A davit arm end 246, which includes a swivel shaft cavity 234 for receiving the swivel shaft 206, is welded to the horizontal member 236.

Because the davit door assembly 200 is part of a chamber into which oxygen is pumped, the parts making up the assembly 200 may be maintained using fluorocarbon lubricants, not hydrocarbon lubricants. Further, the door 112 is quite heavy (it may weigh more than a ton) and yet is preferably movable by individuals who are not particularly strong. Accordingly, the davit arm 214 is specially designed with these considerations in mind. The door is designed to conform to ASME specifications for parts used in pressurized and oxygenated environments. So, for example, under ASME, the door would have a predetermined thickness. In order for the door level adjusting bolts 210A-B to be secured inside the door 112, holes are drilled and tapped into the top of the door to receive and secure the door level adjusting bolts. The drilling and tapping that takes place may reduce the predetermined thickness of the door, a thickness that was intended to conform to the ASME standards. To solve this problem, in some embodiments, the door 112 is a couple of inches taller than the door frame 110. This provides enough clearance for the assembly inside the door that receives the door level adjusting bolts 210A-B. The remainder of the door 112 is positioned adjacent to the door frame 110 and provides a seal under pressure as the oxygen is pumped into the chamber 102. In some embodiments, a gasket 228 forms a seal between the door 112 and the door frame 110. The gasket 228 is shown in FIG. 4. The entire portion of the door 112 that is adjacent to the door frame 110 continues to conform to the ASME specifications, specifically, the door 112 conforms to the thickness specifications.

Additionally, the davit arm 214, which rotates the door 112 between the door frame 110 and the chamber wall, includes two sets of specially designed bearings. Within the vertical member 238, two thrust bearings 230A-B (collectively, thrust bearings 230) and two roller bearings 232A-B (collectively, roller bearings 232) are shown. Each of the bearings 230 and 232 consist of a quantity of round 440-C stainless steel ball bearings, contained within a specially machined housing.

The bearings are shown in more detail in the cross-sectional view of FIG. 6. The thrust bearings 230 are disposed at the top and at the bottom of the vertical member 238 of the davit arm 214. The thrust bearing 230B (at the bottom) supports the weight of the davit arm 214 and the door 112 as the davit arm is moved. Thrust bearings have a top plate and a bottom plate; the top plate moves while the bottom plate is stationary. Thrust bearings are designed to support a thrust load, or the weight of the object. Made using 440-C stainless steel material in some embodiments, the thrust bearings 230, by supporting the heavy weight of the door, enable the davit arm 214 to freely rotate along an arc, from the closed position (against the door frame 110) to a fully opened position (against the wall of the chamber 102). The thrust bearings 230 may be used in an oxygen environment without necessity of hydrocarbon lubricants, such as oil. Further, the thrust bearings 230 enable the very heavy door to be moved quite easily. In some embodiments, the door 112 may be moved with the index finger of each hand.

The roller bearings 232, also made using 440C material in some embodiments, are disposed further inside the vertical member 238 of the davit arm 214 than the thrust bearings 230. Roller bearings are designed to have a shaft through the middle of the torus-shaped bearing. As the shaft rotates, the balls inside the bearing turn against the outside race (the outer surface of the bearing) while the inside race remains stationary against the shaft. The roller bearings 232 in the davit arm 214 ensure that the shaft 216 is able to rotate easily by keeping the main davit arm shaft 216 lined up, which keeps the shaft from flexing or binding. So, the roller bearings 232 enable the davit arm 214 to rotate left to right and vice-versa. The roller bearings 232 are disposed inside a pipe section of the vertical member 238.

In some embodiments, the bearings are composed of 440-C stainless steel. Unlike regular stainless steel, 440-C stainless steel is capable of withstanding the weight stress without undue oxidation, which causes pitting and rusting. Furthermore, normal stainless steel, which is softer than carbon steel, is too soft for roller bearings, but carbon steel readily oxidizes, so 440-C stainless steel is preferred over both normal stainless steel and carbon steel. Further, the bearings are lubricated using a fluorocarbon lubricant, since hydrocarbon oils cannot be used in an oxygen environment.

In some embodiments, the vertical member 238 is manufactured using a three-step process. A carbon steel pipe with an appropriate thickness to support the weight of the door 112 is selected. Two solid pieces of stainless steel are inserted into the pipe, and then machined out to form the bearing cups 244A-B. The bearing cups 244A-B support the roller bearings 232A-B inside the pipe. Specially machined components, bearing spacers 242A-B, are positioned at the bottom of the vertical member 238, so as to hold the roller bearing in place at each end and to provide a flat surface suitable for supporting the thrust bearings.

Figure 7:
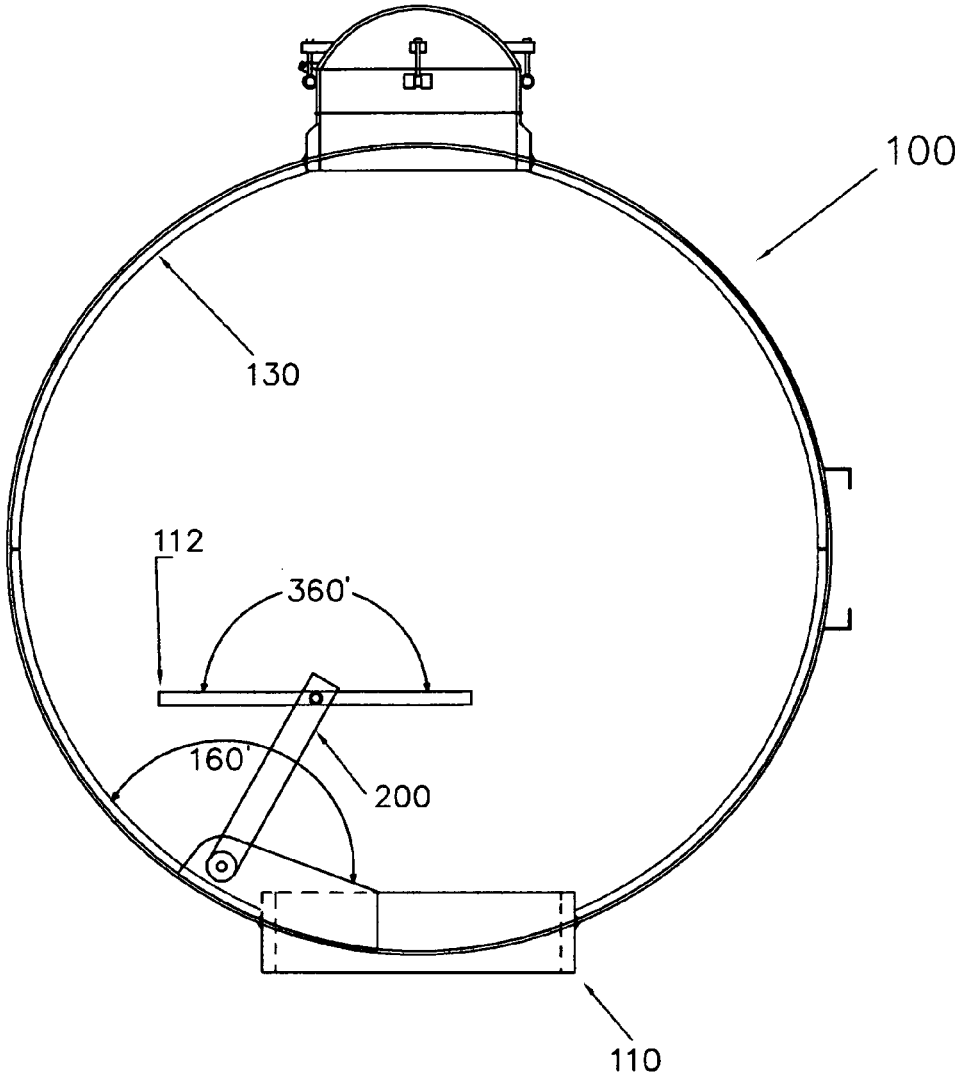
FIG. 7 is an overhead view of the hyperbaric chamber of FIG. 1, showing the rotation capability of the davit door, according to some embodiments.

FIG. 7 is an overhead view of the davit door system 200 within the chamber 102. The door 112 is shown disposed beneath the davit arm 214. The main davit arm shaft 216 is capable of rotating the davit door 214 360° along the shaft. Since the davit arm is also capable of rotating up to 160° from the inside wall of the chamber 102 to the door frame 110, the door may be disposed in a variety of positions adjacent to and to the left of the door frame 110. Because the door 112 is easily moved with little effort, the door may be used to corral the subject, such as a horse, into or out of the chamber. Optionally, the door 112 may include handles on one or both sides of the door (not shown), to facilitate its movement.

Figure 8:
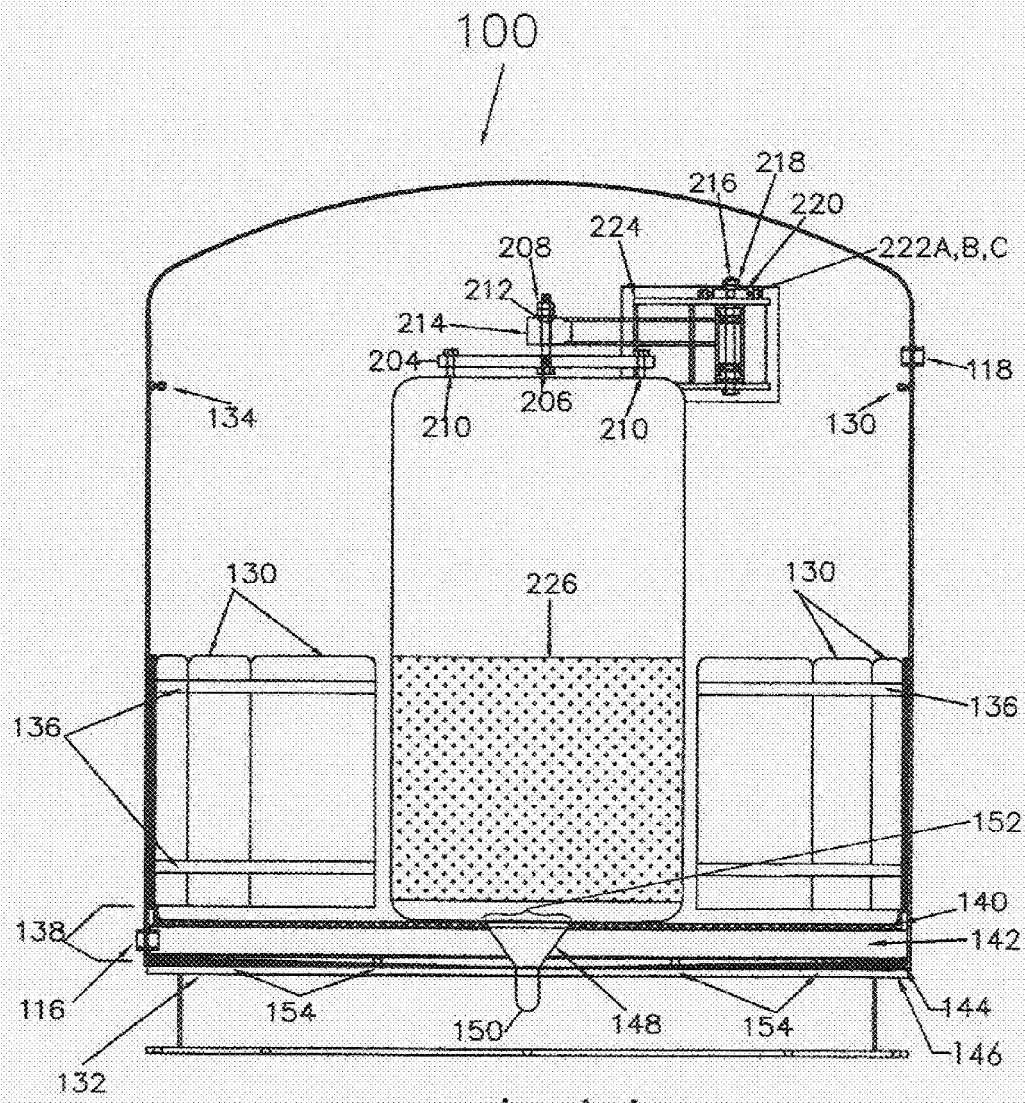
FIG. 8 is a cross-sectional view of the hyperbaric chamber of FIG. 1, viewed from the back, according to some embodiments.

FIG. 8 is a cross-sectional view of the hyperbaric chamber 102 of FIGS. 1-3, according to some embodiments. The chamber is viewed from its back side, and shows the door 112 in a closed position against the door frame 110 (not shown). In some embodiments, the door is actually a couple of inches higher than the door frame. As explained above, this enables the door 112 to conform to ASME width specifications and still provide an adequate seal for pressurizing the chamber 102. Therefore, in the cross-sectional view of FIG. 8, the door 112 is shown partially covering the davit arm support box 224.

The wall cover panels 130 and the door cover panel 226 are also shown. These are used to protect the subject from contact with the metal surface of the chamber 102. In some embodiments, there are eight wall cover panels 130, disposed adjacently around the cylindrical surface of the chamber inner wall. Brass rails 136 are used to secure the wall cover panels 130, although the panels may be secured using epoxies, bolts, and other means. Also shown in the cross-sectional view, one or more eye bolts 134 may be welded or otherwise secured to the inside wall of the chamber 102. The eye bolts 134 may be used to secure a harness or other securing means in order to maintain the subject inside the chamber. Or, multiple eye bolts 134 may be secured with a gurney, a belly sling, or other device, so that a non-ambulatory subject may be comfortably positioned inside the chamber for treatment.

Figure 9:
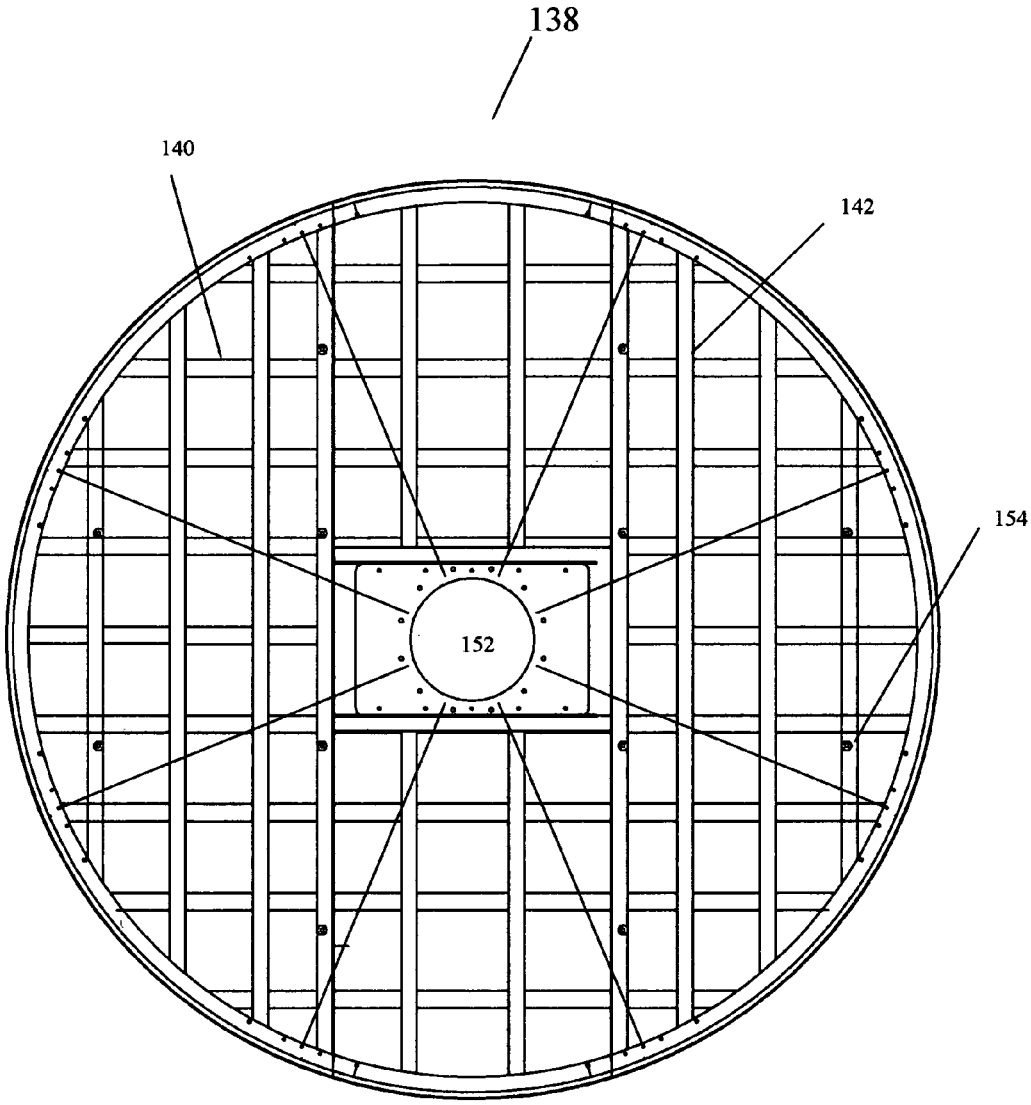
FIG. 9 is an overhead view of part of the floor assembly, according to some embodiments.
Figure 10A:
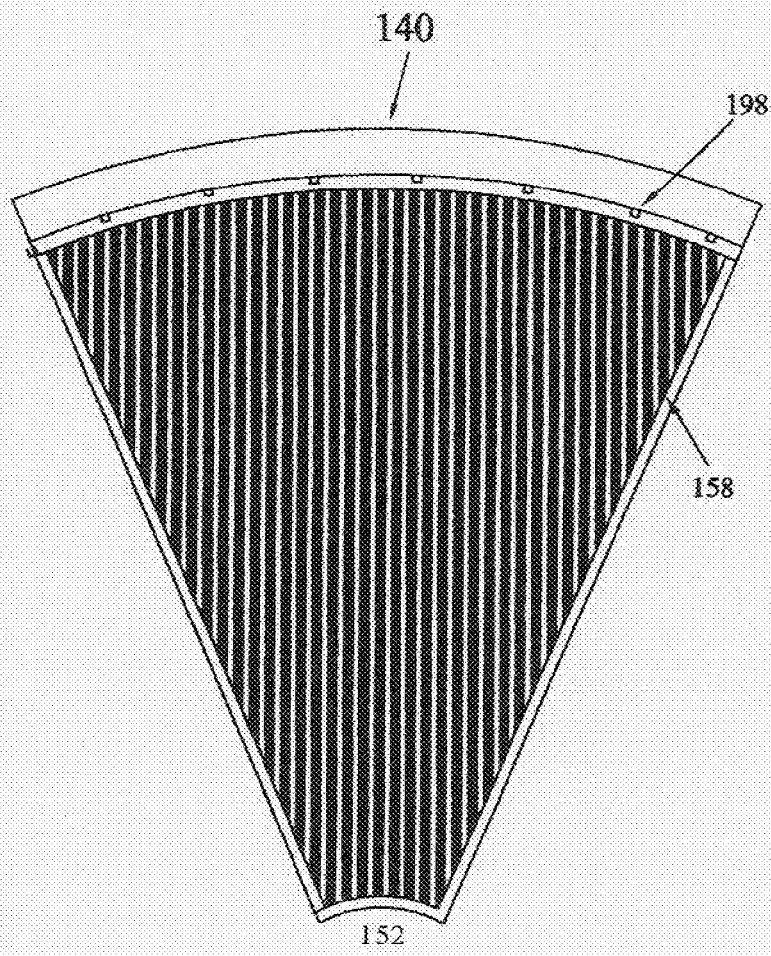
FIGS. 10A and 10B are diagrams of a section of main floor used by the hyperbaric chamber of FIG. 1, according to some embodiments.
Figure 10B:
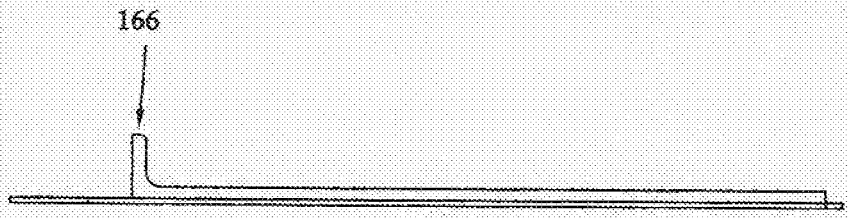

The hyperbaric chamber 102 includes a flooring assembly 138, according to some embodiments, designed with the comfort of the subject and efficiency of cleaning in mind. The flooring assembly 138 includes several distinct parts, a main floor 140, floor framing 142, a sub-floor 144, and a bottom flathead 146. An overhead view of a portion of the flooring assembly 138 is depicted in FIG. 9, and a section of the main floor 140 is depicted in FIGS. 10A and 10B, below.

The main floor 140 consists of eight rigid plates, such as aluminum cut into pie segments; the rigid plates have a special polyurethane floor material hot-molded and bonded to the aluminum floor plates. As with the door cover panel 226 and the wall cover panels 130, the floor material includes a static dissipative material, for use in the oxygen environment. In some embodiments, the polymer material is three-quarters of an inch in thickness and includes a special groove pattern that facilitates movement of waste materials toward the drain 152. FIG. 10A is an overhead view of a pie-shaped section of the main floor 140, including multiple parallel grooves to facilitate drainage toward the drain 128. Also shown are several inlet slits 198, for permitting oxygen to flow upward into the chamber 102. The polymer material is safe for use in oxygen environments and is preferably soft enough to be comfortable for the subject to walk upon. (A horse is likely to be standing in the chamber during treatment.) The main floor 140 may be curved upward where the floor makes contact with the chamber wall, so that the polyurethane material of the flooring approximately meets with the wall cover panels 130. FIG. 10B is a side view of the pie-shaped section, in which an upward curve 166 is depicted. The upward curve 166 is disposed adjacent to the inside wall of the chamber 102, beneath the wall cover panels 130. There is some space between the main floor 140 and the wall cover panels 130, which allows oxygen to be pumped in (by way of the inlet opening 116) beneath the main floor, moves through the space, and fills the chamber 102. Furthermore, a series of grooves are cut into the main floor segments, in some embodiments, to allow the oxygen to flow evenly into the chamber. These grooves allow some water to flow beneath the main floor 140; however, the sub-floor 144 is slightly sloped, so that the excess water will flow to the drain 152.

The floor assembly 138 further includes floor framing 142, upon which the main floor 140 sits. The floor framing 142, made from aluminum or other lightweight but strong material, has a predetermined vertical thickness, as shown in FIG. 8. In some embodiments, the floor framing 142 is five inches thick. In the overhead view of FIG. 9, the floor framing 142 is arranged in a lattice-like configuration, but may assume a number of arrangements to provide structural support for the subject and other individuals who may enter the chamber 102. Indicator lines 156 in FIG. 9 show where the main floor 140 segments are disposed over the floor framing 142.

The sub-floor 144, which is disposed beneath the floor framing 142 and above the bottom flathead 146, is made using a special foam material, coated with a polyurethane finish suitable for oxygen service. The sub-floor 144 is slightly angled so as to facilitate drainage of waste materials and water toward the drain. The sub-floor 144 is glued to the bottom flathead 146 with a special adhesive suitable for an oxygen environment. The sub-floor 144 forms a slope from the outside of the vessel 102 to the drain 152. The bottom flathead 146 is a thick, solid metal component disposed at the base of the chamber 102. A drain pipe 150 welds into the bottom flathead 146 at the drain 152. In some embodiments, the bottom flathead 146 has a 1¼" vertical height.

In some embodiments, the durometer rating of the main floor 140 is different from the durometer rating of the wall cover panels 130 and the door cover panel 226, since the subject will be walking on the floor. In some embodiments, the durometer rating for the main floor 140 is 80A durometer hardness while the durometer rating for the wall cover panels 130 and the door cover panels 226 is 85A durometer. Thus, the main floor 140 is slightly softer than the wall cover panels 130 and the door cover panel 226, in some embodiments. The floor assembly 138 also includes multiple welding bosses 154. The welding bosses 154 are round pieces of metal welded to the bottom flathead 146 that has a drilled and tapped hole in the top of the boss. The floor framing 142 sits on top of the welding bosses and bolts into the bosses, preventing the floor framing 142 from moving. The welding bosses 154 also provide a space for drainage of water or other liquid that makes its way under the main floor, and facilitate the placement of the sub-floor 144.

In the center of the floor assembly 138 is a drain 152. The drain preferably includes a grate of hard anodized aluminum (not shown). A drain cone 148 is disposed beneath the drain 152 and a drain pipe 150. The top of the drain cone 148 is approximately the diameter of the drain 152 while the bottom of the drain cone is approximately the diameter of the drain pipe 150. In some embodiments, the drain cone 148 is formed out of stainless steel.

Figure 11:
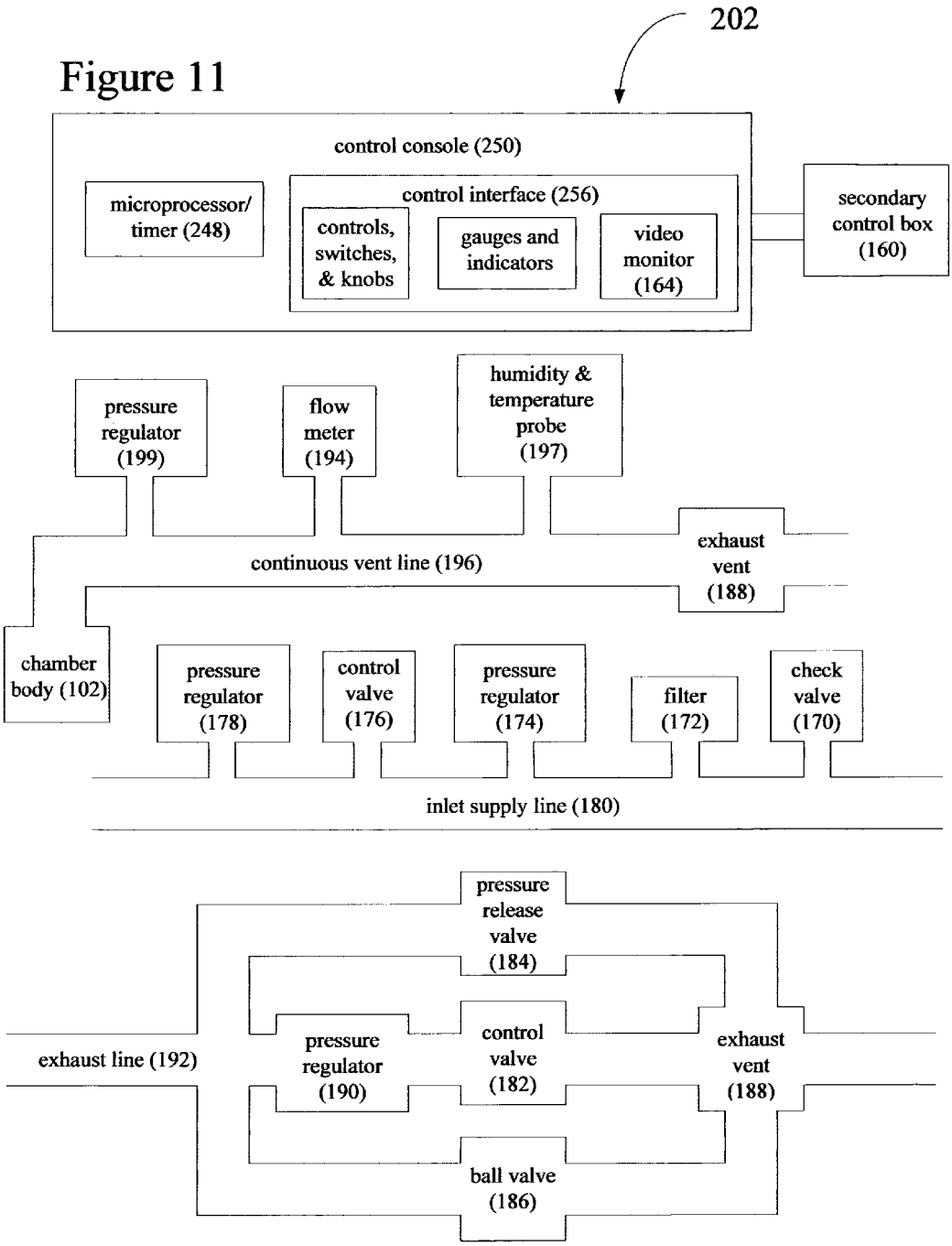
FIG. 11 is a block diagram of the control system used to operate the hyperbaric chamber of FIG. 1, according to some embodiments.

To facilitate the flow of oxygen into and ambient air out of the chamber 102, the hyperbaric system 100 includes a control system 202, as depicted in FIG. 11, according to some embodiments. The control system 202 includes a control console 250, which may be remote from the chamber 102, and a secondary box 160, which is removably attached to the secondary control box supports 124A-B located on an outer wall of the chamber 102. By way of a control interface 256, the control console 250 provides information about the system by way of a video monitor 164, gauges, and indicators. The control interface 256 also provides the ability to manipulate the chamber 102 by way of controls, switches, and knobs, which are discussed in further detail in conjunction with FIG. 13, below. The control console 250 also includes a microprocessor/timer 248, which operates to automatically invoke operations of the chamber 100, whether the operations are default operations or those specified by a technician (using the controls, knobs, and switches).

A flexible cable is disposed between the control console 250 and the secondary control box 160, in some embodiments. The secondary control box 160 may be thought of as a junction box between the control console 250 and the chamber 102. The secondary control box 160 provides a junction between the flexible cables and more rigid pipes connected to the chamber 102. The box 160 also provides a connection between cameras affixed to the portholes 114 and the video monitor 164. The box 160 may also connect to an electrical power source for operating the cameras, one or more solenoid switches, the video monitor 164, as examples, although electrical power remains external to the chamber. The box 160 may connect to an air supply (not the oxygen supply) for powering the pneumatic controls within the system.

Also parts of the control system 202 are the inlet and exhaust lines. In some embodiments, the chamber 102 includes three pipes or lines, an inlet supply line 180, an exhaust line 192, and a continuous vent line 196. Each of these lines is included in FIG. 11, along with components coupled thereto. The pipe through which the oxygen travels into the chamber 102 is the inlet supply line 180; the pipes through which gas is expelled from the chamber are the exhaust line 192 and the continuous vent line 196. The individual components are also considered part of the control system 202. Thus, the two pressure regulators 174 and 178 disposed on the inlet supply line 180 are considered part of the control system 202, as is the flow meter 194 disposed on the continuous vent line 196. The inlet supply line 180 is described further in FIG. 14 and FIGS. 15A-15B; the exhaust line 192 is described further in FIG. 17 and FIG. 18; the continuous vent line 196 is described further in FIG. 21 and FIG. 22, below. Although much of the control system 202 is external to the chamber 102, the control system is considered part of the hyperbaric system 100.

Figure 12:
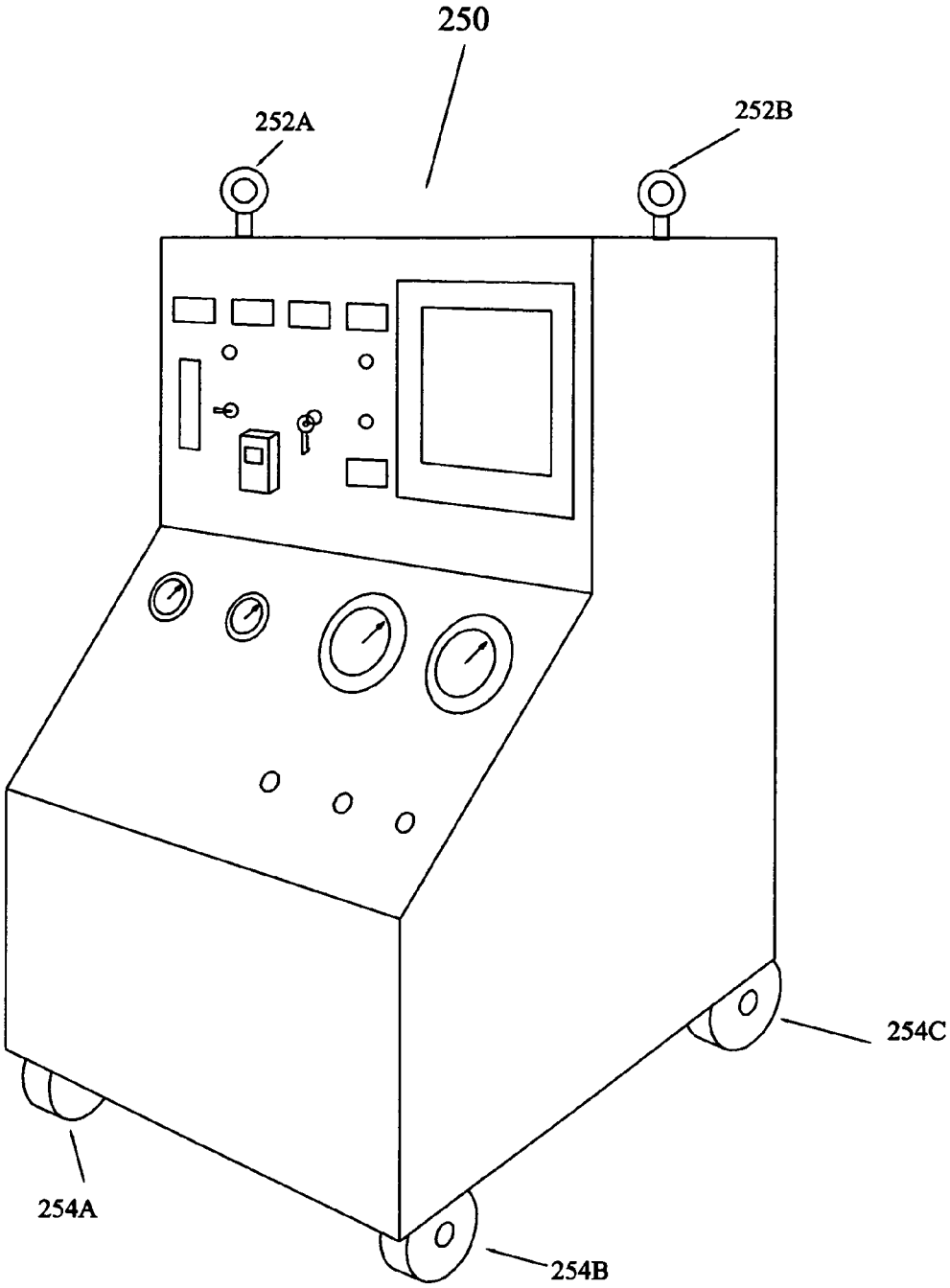
FIG. 12 is a perspective view of a control console for the hyperbaric chamber of FIG. 1, according to some embodiments.

Part of the control system 202, the remote control console 250 is depicted in FIG. 12. The control console 250 enables a technician to operate the hyperbaric system 100 from a location that may be some distance from the chamber itself. (Alternatively, the control console may be not remote from the chamber 102, but may be fixably attached thereto.) The control console 250 includes a pair of lifting lugs 252A and 252B, which allows the control console 250 to be transported or otherwise moved, using a machine such as a crane, much like the chamber 102. Optionally, the control console 250 includes wheels, such as the wheels 254A-C shown in FIG. 12, for ease of movement.

Figure 13:
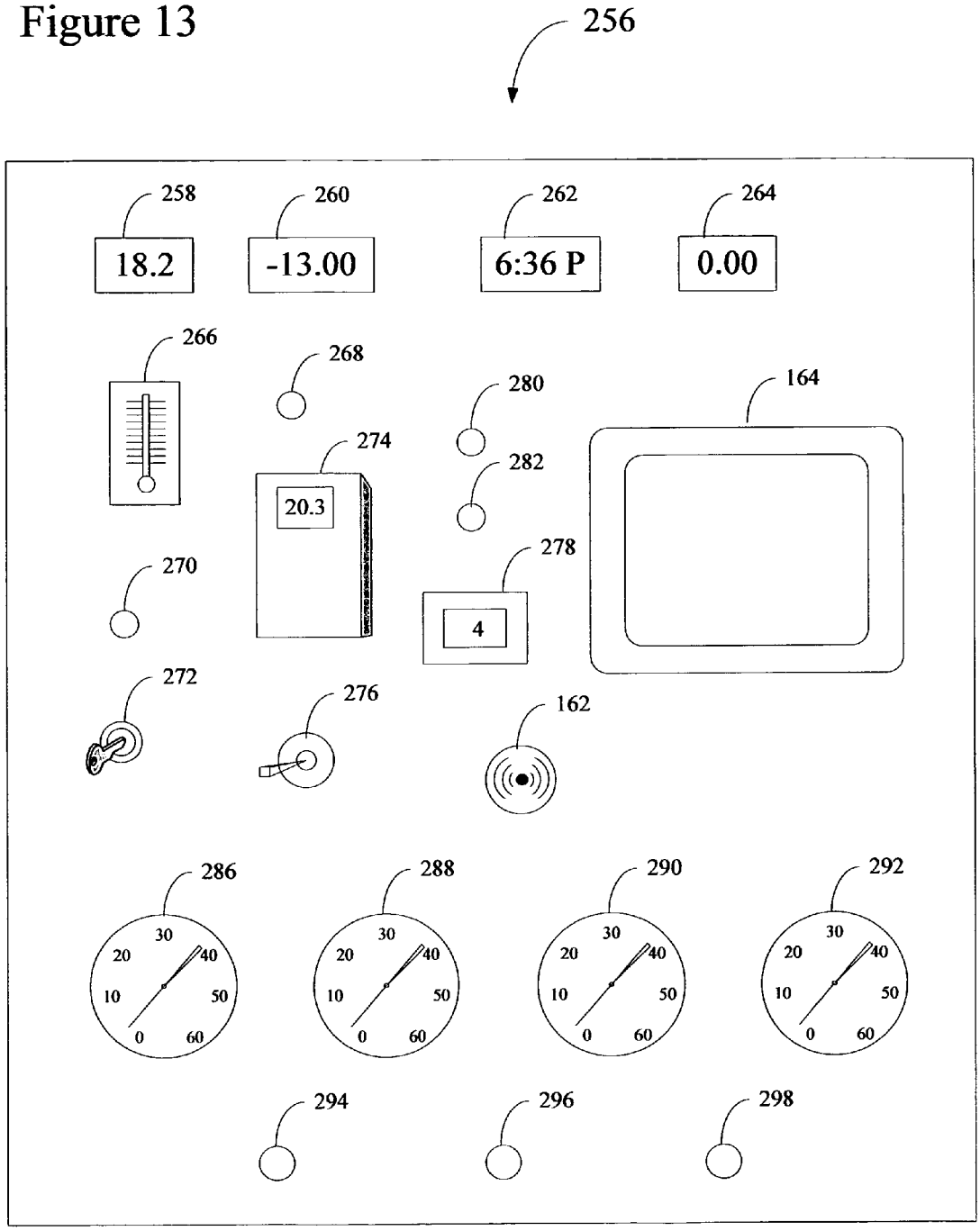
FIG. 13 is a block diagram of the control interface of the control console of FIG. 12, according to some embodiments.

The control console 250 includes the control interface 256, which includes indicators, such as gauges and light emitting diodes (LEDs), controls, such as switches and knobs, and a video display 164 for remote viewing of the inside of the chamber 102. While tubes are coupled between the control console 250 and the chamber 102, there are no electrical connections or wires inside the chamber. Instead, the control system 202 is an electro-pneumatic system, since avoidance of electrical signals in high-oxygen environments is preferred for safety reasons. A detailed diagram of the control interface 256 is depicted in FIG. 13, according to some embodiments. Although the control console 250 is depicted as being remote from the chamber 102, references herein to the hyperbaric system 100 are meant to include the control console 250.

The control interface 256 includes a video monitor 164. Recall that the portholes 114 disposed around the chamber 102 may be affixed with cameras. The images received from the cameras may be presented to the video monitor 164. This allows a user of the control console 250 to have a real-time view of the subject within the chamber 102 without having to peer into the portholes 114. Further, the video monitor 164 may be part of a personal computer (not shown), which may then send the images to another computer, or to a web page, for more widespread viewing of the events taking place within the chamber. As another option, the image received by the cameras may be recorded on a video recording device (not shown), which may be part of the control console 250. In some embodiments, the video monitor supports a split screen, so that up to four images may be simultaneously viewed.

The control interface 256 includes a number of indicators. At the top of FIG. 13, LED-type indicators are depicted, a relative humidity indicator 258, a temperature indicator 260, a real-time clock 262, and a timer 264. The relative humidity indicator 258 indicates the relative humidity inside the chamber 102 at any given-time. The temperature indicator 260 indicates the temperature inside the chamber. The real-time clock 262 indicates the time of day, and is not tied to any of the events taking place within the chamber 102. The timer 264 enables a user to know when the hyperbaric oxygenation process has begun, when the ambient air has left the chamber, when the pressure within the chamber has reached the desired state, and so on. A start timer indicator 280 and a reset/stop timer indicator 282 are provided to assist the technician in understanding the information being provided by the timer 264.

An oxygen flow meter 266 and an oxygen analyzer 274 are also part of the control interface 256. The oxygen analyzer 274 indicates the percentage of oxygen in the chamber 102. However, a sensor on the oxygen analyzer 274 receives oxygen at low pressure (1 psi). Thus, along with a small regulator (not shown), the oxygen flow meter 266 controls the flow going across the sensor of the oxygen analyzer 274, allowing the analyzer to get an accurate reading. If the percentage of oxygen in the chamber 102, as indicated by the oxygen analyzer 274, is too low, a second flow meter 194 is adjusted (not shown). The second flow meter 194 is described in more detail in conjunction with the description of FIG. 21, below. The interface 256 also features a power-on indicator LED 270 and an ON/OFF key 272. A manual vent pressure/switch 276, which has either a "vent" state or a "pressure" state, enables the technician to swap between pressurization and venting or depressurization of the chamber 102, as desired. That switch is to swap between pressurization and venting or depressurization.

The control interface 256 includes a number of gauges for monitoring the characteristics within the chamber during use. An oxygen inlet pressure gauge 286, an air supply gauge 288, a set pressure gauge 290, and a chamber pressure gauge 282 are all shown in FIG. 13. The oxygen inlet pressure gauge 286 monitors the oxygen pressure, not inside the chamber 102, but inside the flow tube connected to the inlet opening 116. The air supply gauge 288 indicates available air pressure from the air compressor used to operate the pneumatic controls within the control system 202 of the hyperbaric system 100. The set pressure gauge 290 indicates the desired set pressure of the chamber 102 while the chamber pressure gauge 292 indicates the actual pressure inside the chamber.

The control interface 256 also includes control knobs that allow the technician to change the characteristics of the gases within the chamber 102. A set pressure adjust knob 294, a pressurization rate knob 286, and a de-pressurization knob 298 are shown in FIG. 13. The set pressure adjust knob 294 allows the technician to modify the pressure that has previously been designated. The pressurization rate knob 296 allows the technician to adjust the rate at which the chamber 102 is being pressurized. The de-pressurization knob 298 allows the technician to modify the rate at which oxygen is leaving the chamber 102.

Finally, the control interface 256 includes a high oxygen alarm 162, and a cycle counter 278. The high oxygen alarm 162 emits an audible indicator whenever the pressure in the source oxygen tanks exceeds a predetermined pressure. In some embodiments, the liquid oxygen tank connected to the inlet supply line of the hyperbaric system 100 includes a regulator for ensuring that the oxygen enters the supply line at a predetermined pressure, such as 250 pounds or less. The high oxygen alarm 162 will sound when the oxygen inlet pressure gauge 286 exceeds the predetermined pressure. The cycle counter 278 includes an LED indicator of the number of cycles, or hyperbaric oxygen therapy treatments, completed using the hyperbaric system 100. The cycle counter 278 may thus be useful for revenue sharing of the chamber or to keep track of periodic maintenance schedules. The various indicators, gauges, and knobs, and other controls depicted in the control interface 256 are merely illustrative. Engineers of ordinary skill in the art will recognize a number of control interfaces that may be designed to control oxygen ingress and egress within the chamber 102.

Figure 14:
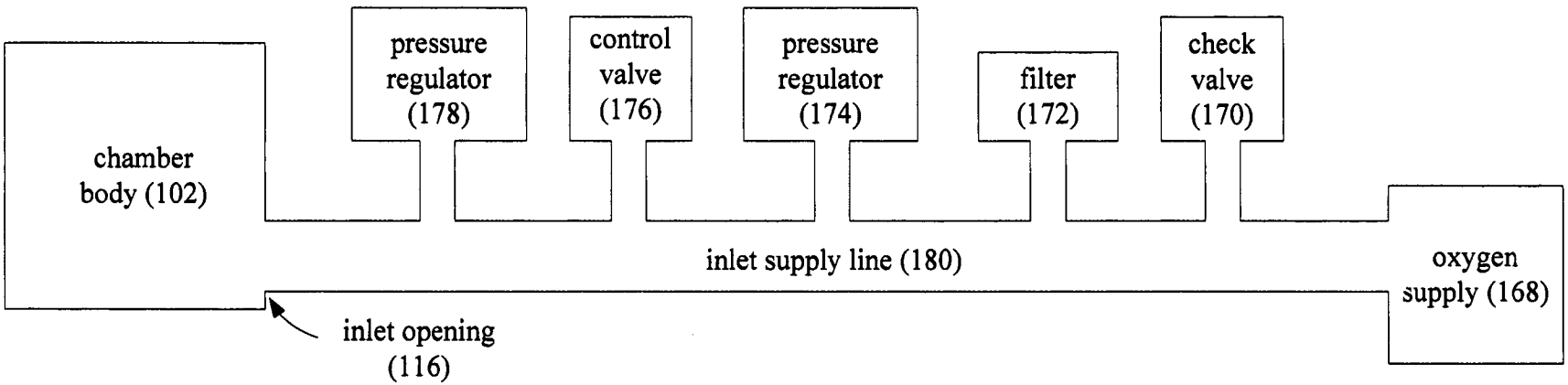
FIG. 14 is a block diagram of an inlet supply line used to supply oxygen to the hyperbaric chamber of FIG. 1, according to some embodiments.
Figure 15A:
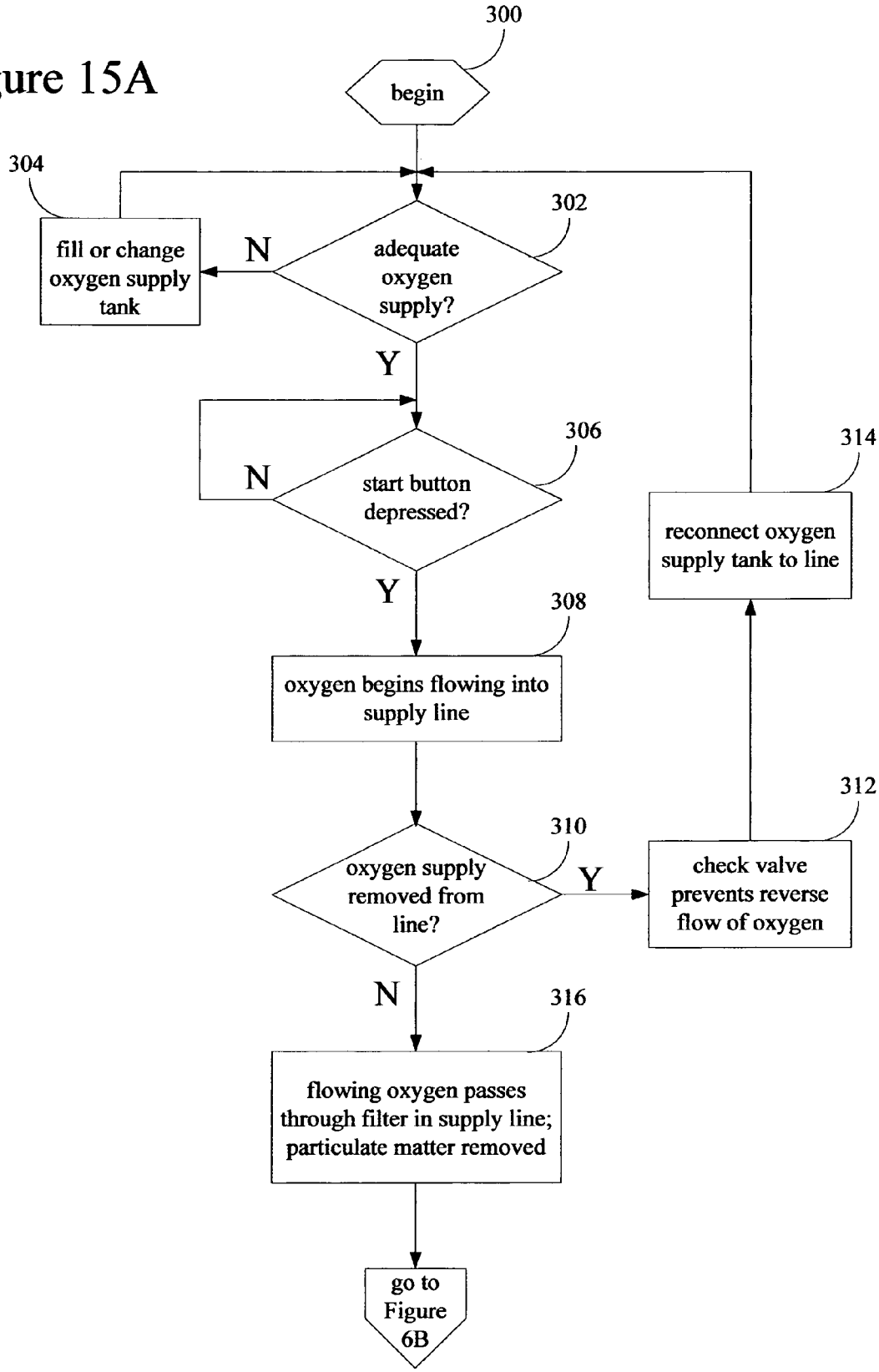
FIGS. 15A and 15B are a flow diagram of the inlet flow mechanisms of the hyperbaric chamber of FIG. 1, according to some embodiments.
Figure 15B:
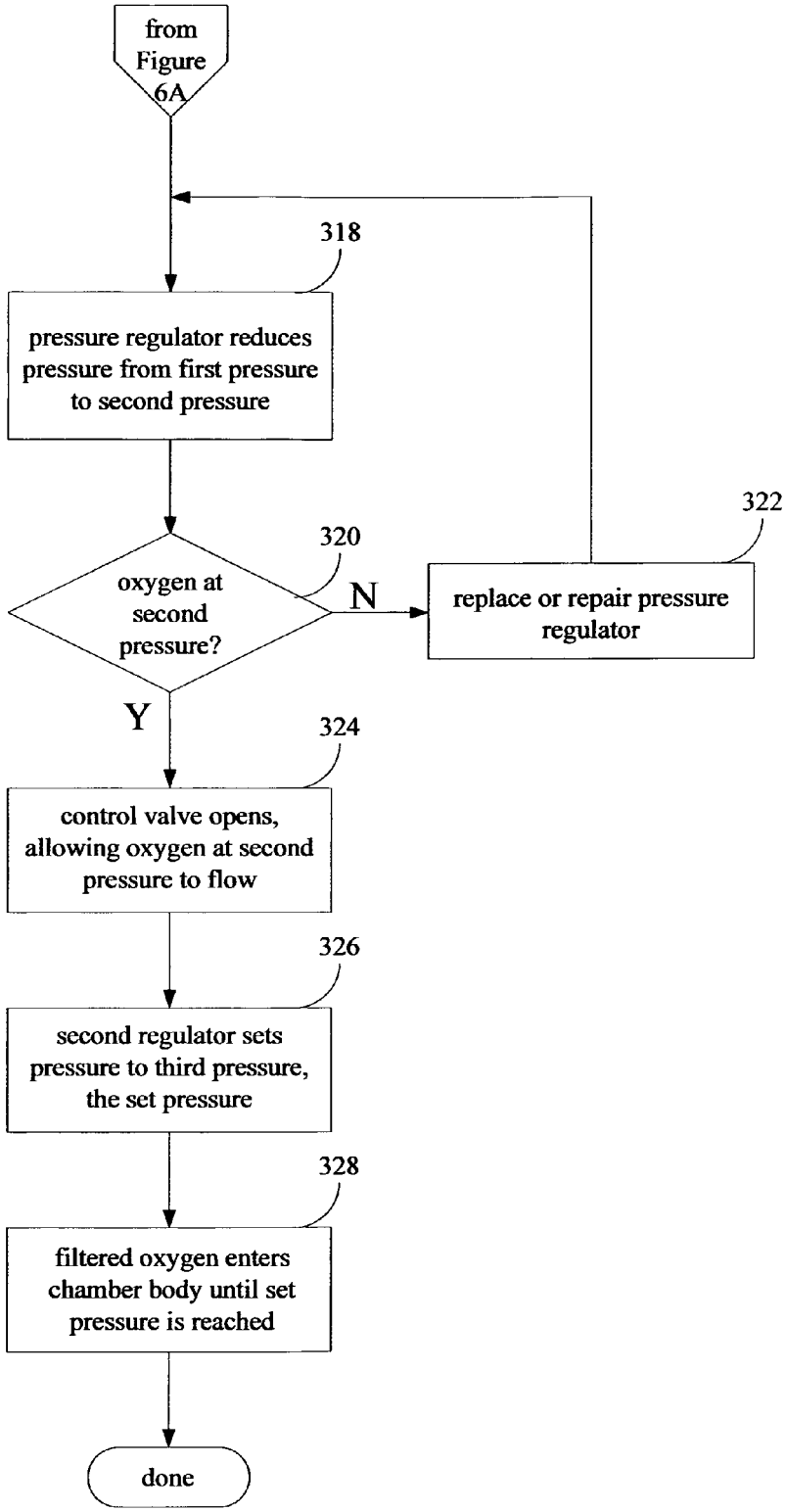

FIG. 14 is a simplified diagram of the inlet supply line 180, according to some embodiments. Recall that the inlet supply line 180 is part of the control system 202 of the hyperbaric system 100. The inlet supply line 180 is coupled between an oxygen supply 168, such as an oxygen tank, and the chamber body 102, for dispensing oxygen into the chamber. One or more of the components making up the inlet supply line 180 may be controlled by adjusting controls, switches, or knobs on the control interface 250, or the components may operate automatically. Among the components coupled to the inlet supply line 180 are a check valve 170, a filter 172, a first pressure regulator 174, a control valve 176, and a second pressure regulator 178. FIGS. 15A and 15B, below, provide a detailed description of the operation of the inlet supply line 180, including these components.

Figure 18:
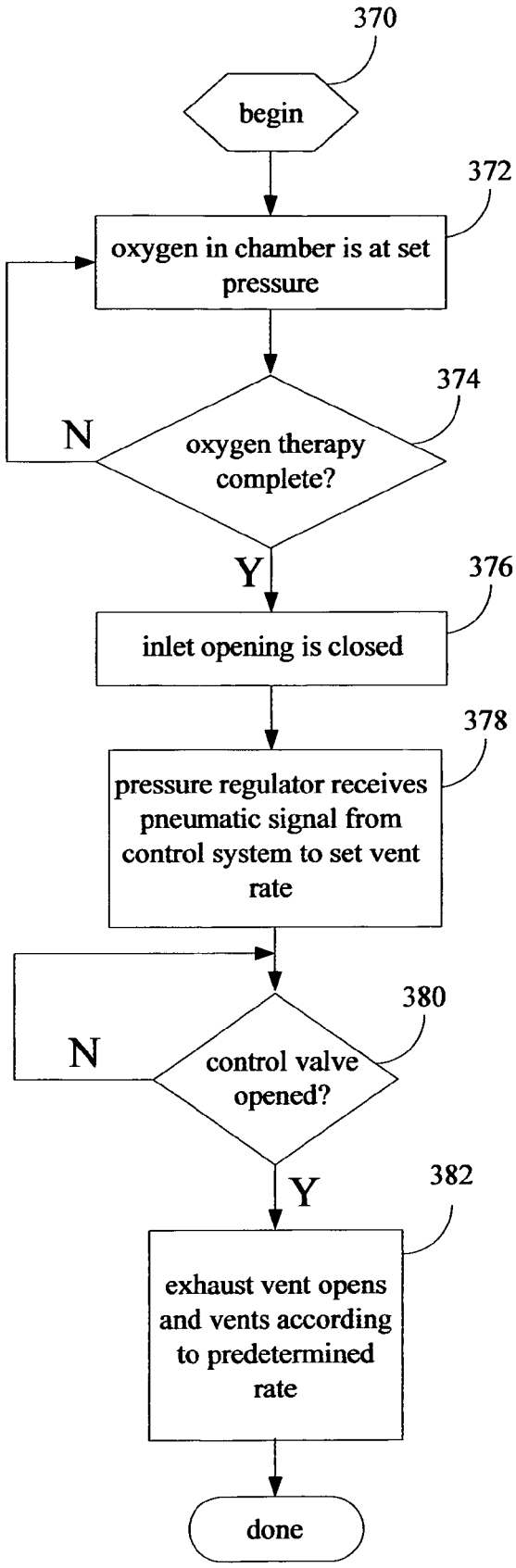
FIG. 18 is a flow diagram of the exhaust flow mechanism of the hyperbaric chamber of FIG. 1, according to some embodiments.

Not shown in either the control console 250 or the control interface 256, the control system 202 performs the functions of the hyperbaric system 100, including inlet flow of oxygen (FIGS. 15A and 15B), the generation of the pressurized environment inside the chamber (FIG. 16), and the exhaust flow of ambient air/oxygen (FIG. 18). These functions are described in more detail, below. The microprocessor/timer 248 of the control system 202 may include pure hardware, a combination of hardware and software, or pure software. The functions performed in FIGS. 15A, 15B, 16, 18, 19, 20, and 22 are controlled by the control system 202.

FIGS. 15A, 15B, 16, 18, 19, 20, and 22 are flow diagrams which depict process operations of the hyperbaric system 100, according to some embodiments. In each of the flow diagrams disclosed herein, various embodiments may utilize fewer or more steps, and the method of the flow diagrams may be performed using a number of different implementations, depending on the application. Furthermore, many of the process steps may be performed in a different order than is depicted herein.

FIGS. 15A and 15B include a flow diagram 300 of the operation of the inlet flow mechanism of the hyperbaric system 100, according to some embodiments. Recall that the inlet opening 116, located close to the bottom of the chamber 102, receives pure oxygen, which flows into the chamber until a predetermined pressure is achieved within the chamber. The steps involved in filling the chamber with an adequate pressure of oxygen are described in FIG. 16, below. The flow diagram 300 relates to the delivery of oxygen from an external oxygen supply tank to the chamber 102.

The flow diagram begins by ascertaining whether there is an adequate supply of oxygen for filling the chamber 102 at a predetermined pressure (block 302). The inlet supply line 180 connected at one end to the inlet opening 116 of the chamber is connected at its other end to the oxygen supply 168, such as a tank. Recall that the oxygen being received into the inlet supply line 180 is received at a predetermined pressure, indicated by the oxygen inlet pressure gauge 286; if the pressure exceeds a predetermined amount, the high oxygen alarm 162 will sound. Before feeding oxygen into the chamber 102, the control system 202 determines whether the oxygen supply 168 is sufficient. If not (the "no" prong of block 302), the oxygen supply 168 is filled or replaced (block 304). If so (the "yes" prong of block 302), the start button is checked (block 306). In some embodiments, when the start button is depressed (the "yes" prong of block 306), an electrical connection goes to a solenoid valve within the inlet supply line 180 and opens the check valve 170, causing oxygen to flow from the oxygen tank into the inlet supply line (block 310). Until this happens (the "no" prong of block 306), no oxygen will flow into the inlet supply line 180.

The oxygen that is dispensed into the inlet supply line 180 is under very high pressure, typically 200 pounds of pressure. It may be the case that the oxygen tank or other supply is removed from the inlet supply line (block 310), accidentally or otherwise. If this occurs (the "yes" prong of block 310), the check valve 170 prevents oxygen already in the inlet supply line from reversing direction and shooting back out (block 312). This fail-safe mechanism may prevent injury. The oxygen supply 168 is reattached or replaced before the inlet flow of oxygen may recommence (block 314).

After the check valve 170 in the inlet supply line 168, the oxygen under high pressure passes through the filter 172, which removes particulate matter from the oxygen gas (block 316). In some embodiments, the filtration is down to particles less than ten microns in size. This ensures that before entering the chamber 102, the oxygen is in a clean state. (At this point, the flow diagram 300 continues in FIG. 15B.)

Following filtration, the pressure regulator 174 in the inlet supply line 180 reduces the oxygen pressure from a first pressure to a second pressure (block 318). In some embodiments, the first pressure is 200 pounds while the second pressure is 35 pounds. A pressure sensor checks to ensure that the oxygen is flowing at the second pressure (block 320). If not (the "no" prong of block 320), the pressure regulator 174 is faulty and is replaced or repaired (block 322). If the oxygen is flowing at the second pressure (the "yes" prong of block 320), control valve 176 opens, allowing the oxygen to flow in the inlet supply line 180 at the second pressure (block 324). In some embodiments, the control valve 176 is controlled by a pneumatic signal sent from the control console 250 to the inlet supply line 180. Pneumatic signals are preferred over electrical signals in oxygen environments, so as to minimize any fire hazard.

The oxygen flows to the second pressure regulator 178 in the inlet supply line 180. The second pressure regulator 178 further reduces the oxygen pressure to a third pressure, known as the "set pressure" (block 326). Recall that the control interface 256 (FIG. 13) includes both a set pressure gauge 290 and a set pressure adjust knob 294. The pressure designated by the technician using the set pressure knob 294 is the pressure maintained by the second pressure regulator. Once the set pressure is reached in the inlet supply line 180, the filtered oxygen flowing at the set pressure is received into the chamber 102 at the inlet opening 116. The inlet flow diagram is thus complete.

Figure 16:
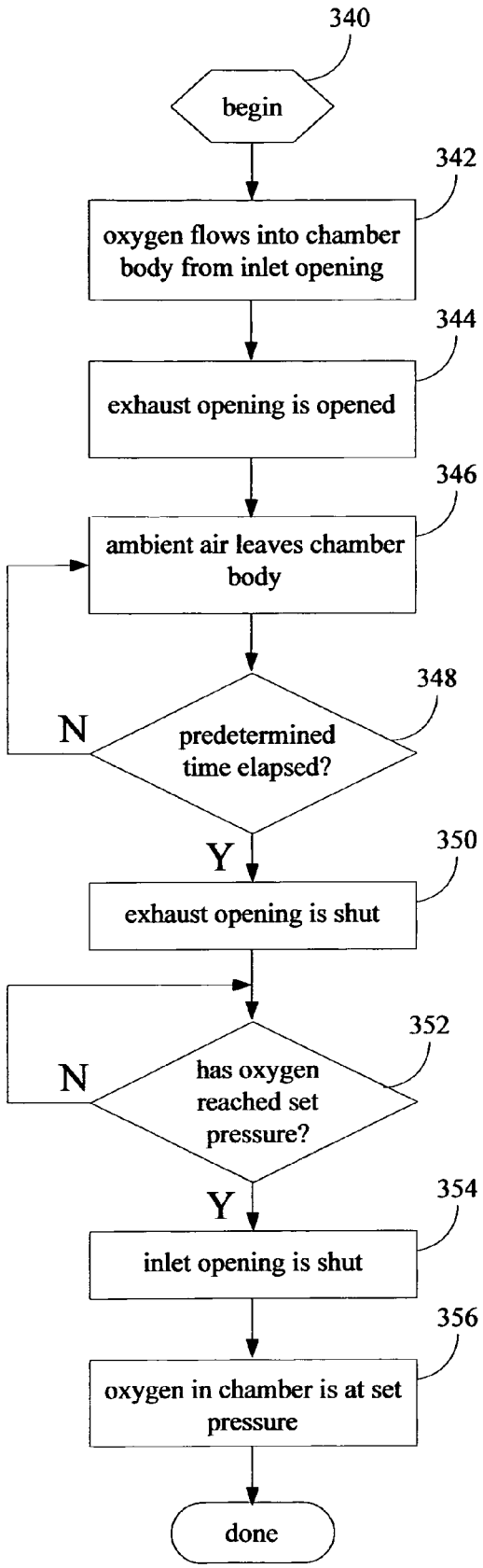
FIG. 16 is a flow diagram of the process for achieving a set pressure within the hyperbaric chamber of FIG. 1, according to some embodiments.

FIG. 16 is a flow diagram 340 of the generation of the pressurized environment inside the hyperbaric system 100, according to some embodiments. Various embodiments may utilize fewer or more steps, and the method of the flow diagram 300 may be performed using a number of different implementations, depending on the application. Furthermore, many of the process steps may be performed in a different order than is depicted herein. For example, the steps of blocks 342 and 344 may be reversed, and other changes to the steps may be made without departing from the spirit of the invention. Because the pressurized environment cannot be maintained until all openings are eventually closed, it is assumed that the door frame 110 is covered with the door 112 and that the man way 120 is closed. The other two openings (the inlet-opening 116 and the exhaust opening 118) are manipulated during the process steps of the flow diagram 340.

The flow diagram 340 begins where the flow diagram 300 left off: oxygen at a set pressure is flowing into the chamber 102 (block 342) by way of the inlet opening 116. (However, the oxygen inside the chamber 102 has not reached the set pressure.) The exhaust opening 118 is opened (block 344). By opening the exhaust opening 118, the ambient air inside the chamber 102 is able to flow out of the chamber (block 346).

Since the oxygen is flowing into the chamber 102 at its base (see inlet opening 116 in FIG. 1), the pressurized oxygen moves the ambient air out through the exhaust opening 118, located at the top of the chamber. Depending on the size of the chamber and the set pressure, this process may take only a few minutes. The time it takes for the ambient air to leave the chamber may be empirically determined under various set pressures. The control system 202 may then ascertain whether this predetermined time period has elapsed (block 348). If not (the "no" prong of block 348), the exhaust opening remains open, allowing further escape of ambient air. If, instead, the predetermined time period has elapsed (the "yes" prong of block 348), the control system 202 closes the exhaust opening, preventing further escape of any gas, whether oxygen or ambient air (block 350). Oxygen continues to flow into the inlet opening at the set pressure rate.

However, because the chamber 102 is substantially larger than the inlet supply line 180, it will take time for the oxygen inside the chamber 102 to reach the set pressure. Until such time (the "no" prong of block 352), the oxygen continues to flow in from the inlet supply line 180. Once the set pressure has been reached (the "yes" prong of block 352), the inlet opening 116 is shut, and no new oxygen is received into the chamber (block 354), except as need to replace the respirated air removed through constant vent by way of a flow meter. A flow diagram in FIG. 22 describes this process in more detail, below. Because all possible openings of the chamber 102 are closed (door frame 110, man way 120, inlet opening 116, and exhaust opening 118), the oxygen inside the chamber 102 is maintained at the set pressure, as desired (block 356).

Figure 17:
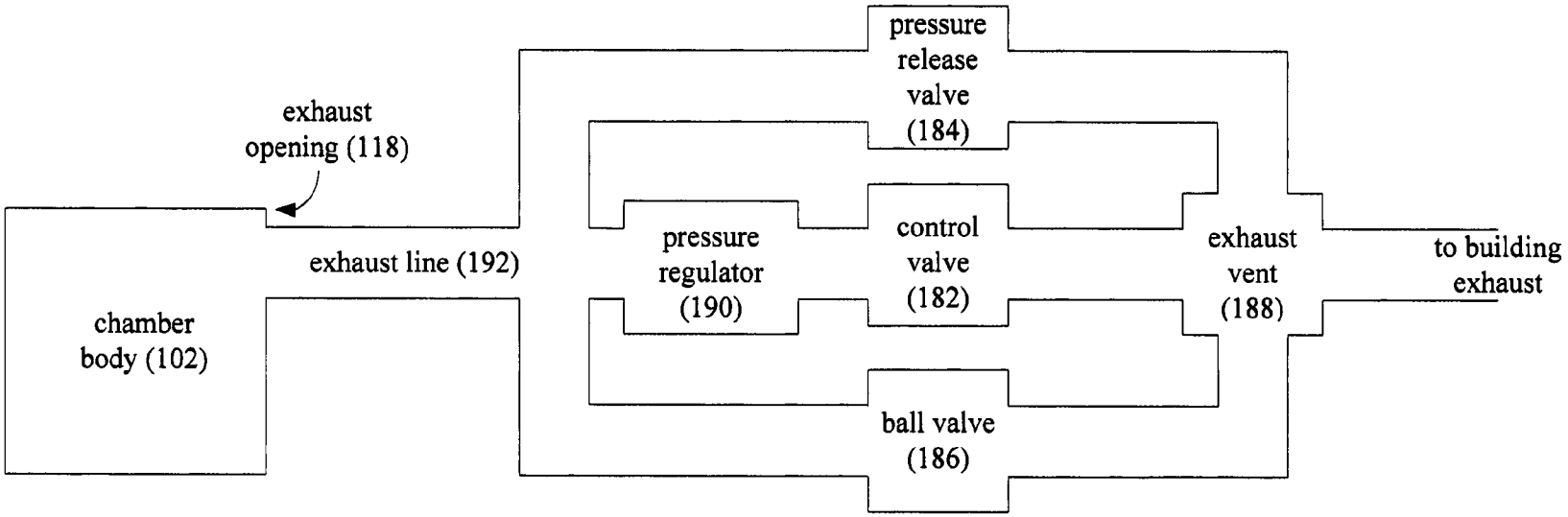
FIG. 17 is a block diagram of an exhaust line used to release gases from the hyperbaric chamber of FIG. 1, according to some embodiments.
Figure 19:
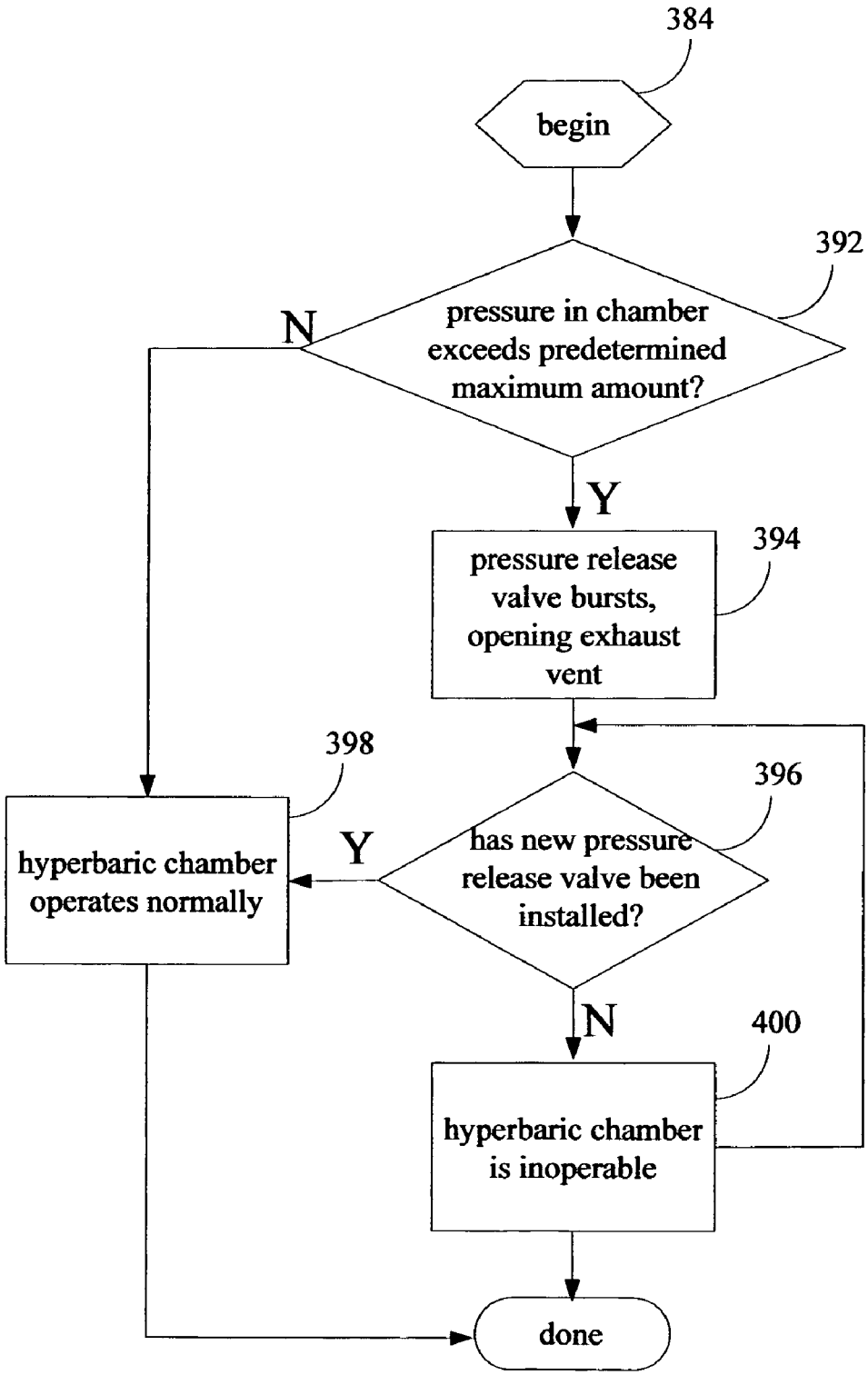
FIG. 19 is a flow diagram of a first failsafe mechanism of the hyperbaric chamber of FIG. 1, according to some embodiments.
Figure 20:
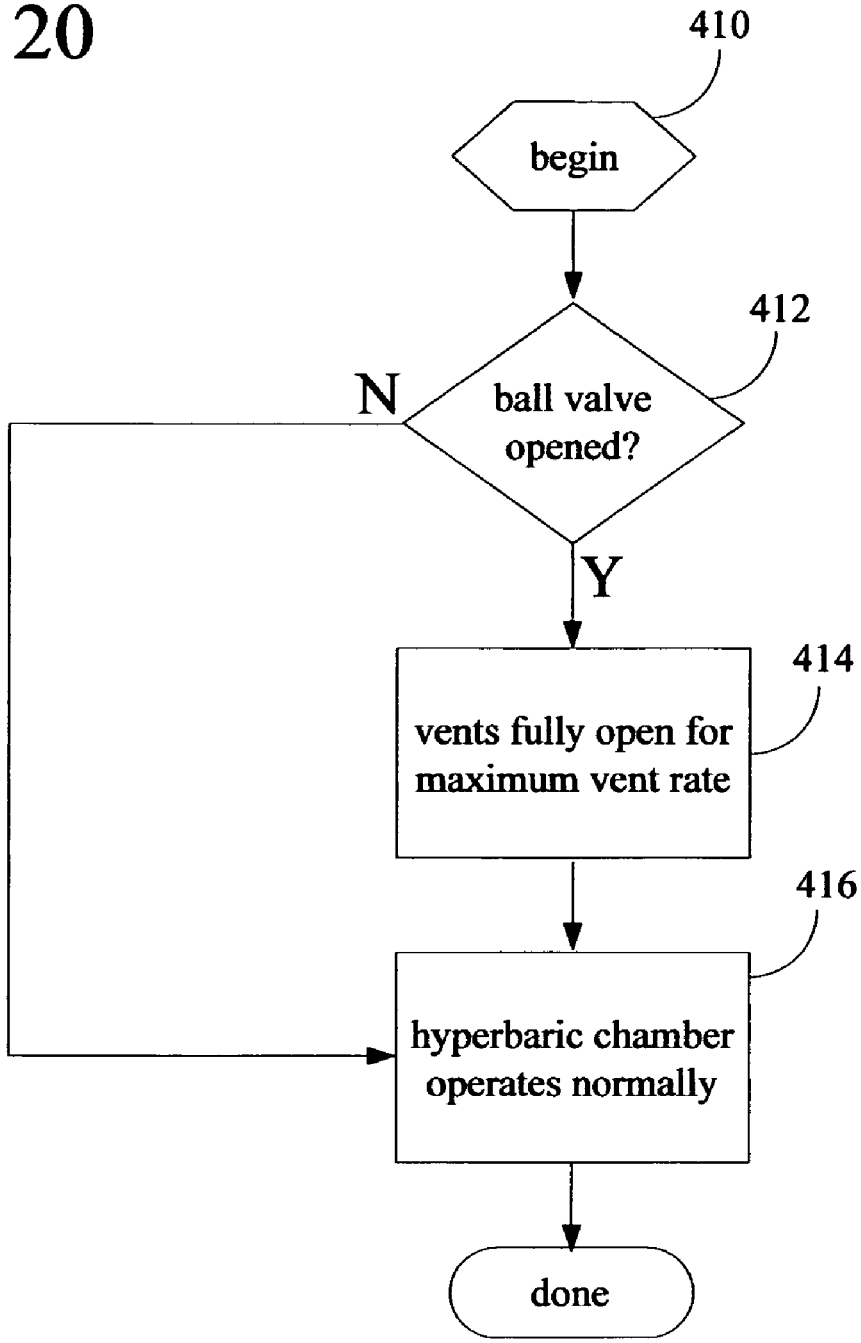
FIG. 20 is a flow diagram of a second failsafe mechanism of the hyperbaric chamber of FIG. 1, according to some embodiments.

FIG. 17 is a simplified block diagram of the exhaust line 192, according to some embodiments. Recall that the exhaust line 192 is part of the control system 202 of the hyperbaric system 100. The exhaust line 192 is coupled between the chamber 102 and a building exhaust external to the hyperbaric system 100, and is preferably located close to the top of the chamber 102, as shown in FIG. 1. Among the components coupled to the exhaust line 192 are a control valve 182, a pressure release valve 184, a ball valve 186, an exhaust vent 188, and a pressure regulator 190. FIGS. 18-20, below, provide a detailed description of the operation of the exhaust line 180, including these components.

FIG. 18 is a flow diagram of the operation of an exhaust flow mechanism 370 of the hyperbaric system 100, according to some embodiments. The exhaust flow mechanism 370 will be engaged in the hyperbaric system 100 once hyperbaric oxygen therapy is completed, during normal operation. FIGS. 19 and 20 are flow diagrams depicting the process flow for a couple of failsafe conditions that may be implemented, both of which cause the chamber to exhaust or release gas from the chamber. FIGS. 19 and 20 are described in more detail, below.

As the exhaust flow mechanism 370 commences, the oxygen inside the chamber 102 is assumed to be at or near the set pressure (block 372). Until hyperbaric oxygen therapy is complete, oxygen continues to be maintained at the set pressure, as described further in FIG. 22, below. Once the hyperbaric oxygen therapy is complete (the "yes" prong of block 374), the inlet opening 116 is closed (block 376), preventing oxygen from further entering the chamber 102.

A pressure regulator 190 located in the exhaust line receives a pneumatic signal from the control system 202 to set the rate at which the gases are vented from the chamber (block 378). Recall that the control console 250 includes a de-pressurization knob 298. This knob controls the pneumatic signal sent to the pressure regulator 190 inside the exhaust line 192. Until a control valve is opened, however, the exhaust vent 188 in the exhaust line 192 will not open (block 380). Once opened, the vent 188 permits the oxygen and other gases (mostly oxygen) to be released from the chamber 102 (block 382).

FIG. 19 is a flow diagram of the operation of an automatic failsafe mechanism 390 for limiting the maximum pressure inside the chamber 102, according to some embodiments. The hyperbaric system 100 includes a pressure release valve 184, which is designed to burst when the pressure inside the chamber exceeds a predetermined maximum amount. In some embodiments, the pressure release valve 184 will burst when the pressure in the chamber 102 has exceeded 35 PSI. This is a failsafe mechanism designed to keep the chamber from accidentally overfilling, in case one or more components of the control system 202 fails.

The automatic failsafe mechanism 390 may occur during any state of the hyperbaric system 100, whether the chamber 102 is idle, oxygen is flowing into the chamber, the hyperbaric oxygen therapy is taking place at the set pressure, or during the exhaust flow mechanism. As designed, the chamber 102 is designed to not exceed the predetermined maximum pressure. However, if one or more of the components of the system fail, the failsafe mechanism 390 protects against injury or death to the subject, who may be in the chamber during the failure.

The failsafe mechanism 390 commences by automatically identifying whether the maximum pressure in the chamber 102 has exceeded the predetermined amount (block 392). If not (the "no" prong of block 392), the hyperbaric system 100 operates normally (block 398). If the maximum pressure is exceeded (the "yes" prong of block 392), the pressure release valve automatically bursts, opening the exhaust vent 188 (block 394). The oxygen and other gases are released quickly from the chamber 102. At this point, the hyperbaric system 100 is no longer operable, because the pressure release valve is broken (block 396).

If a new pressure release valve is installed in the control system 202, the hyperbaric system 100 operates normally again (block 398), that is, until the pressure again exceeds the predetermined maximum allowable pressure. If the pressure release valve is not replaced, the hyperbaric chamber remains inoperable (block 400).

In FIG. 20, a second failsafe mechanism 410 of the hyperbaric system 100 is described in a flow diagram, according to some embodiments. In contrast to the automatic failsafe mechanism 390 of FIG. 19, the failsafe mechanism 410 of FIG. 20 is manual, that is, invoked by a technician, a veterinarian, or another person. Although the failsafe mechanism 410 does vent oxygen and other gases quickly from the chamber 102, this second failsafe mechanism 410 is not related to exceeding a maximum pressure (since the hardware of the control system 202 automatically prevents that occurrence), but is intended to exhaust the chamber 102 quickly, for any reason. For example, the failsafe mechanism 410 may be invoked is when the subject becomes agitated, when the subject remains agitated for an extended period of time, when the subject's behavior is in conflict with his well-being, when the subject faints, etc. The failsafe mechanism 410 may be invoked at any time, while oxygen is flowing into the chamber, during hyperbaric oxygen therapy, and while the exhaust vent 188 is opened (to speed up the release of oxygen and other gases). The failsafe mechanism 410 begins when the ball valve 186 is opened (block 412). The control system 202 of the hyperbaric system 100 includes a ball valve 186 located on the outside of the chamber 102 for easy access. If the vent/pressure switch 276 (see control console 256 in FIG. 13) is not set to "vent" (the "no" prong of block 412), the hyperbaric system 100 operates normally (block 416). If, instead, the vent/pressure switch 276 is set to "vent" (the "yes" prong of block 412), the vent 188 in the exhaust line 192 is fully opened, allowing the chamber 102 to vent oxygen and other gases quickly (block 414).

After the chamber 102 has achieved the predefined set pressure, the subject may be in the chamber receiving hyperbaric oxygen therapy for an extended period of time. For example, a horse may receive treatment in the chamber for fifty to seventy-five minutes. During this time, the horse is respirating, which will slowly decrease the oxygen concentration inside the chamber 102. Accordingly, the continuous vent line 196 enables a small amount of gas to be released from the chamber continuously, while the inlet opening 116 is periodically opened, allowing new oxygen to enter the chamber. This process is described in a flow diagram 420 in FIG. 22, below.

Figure 21:
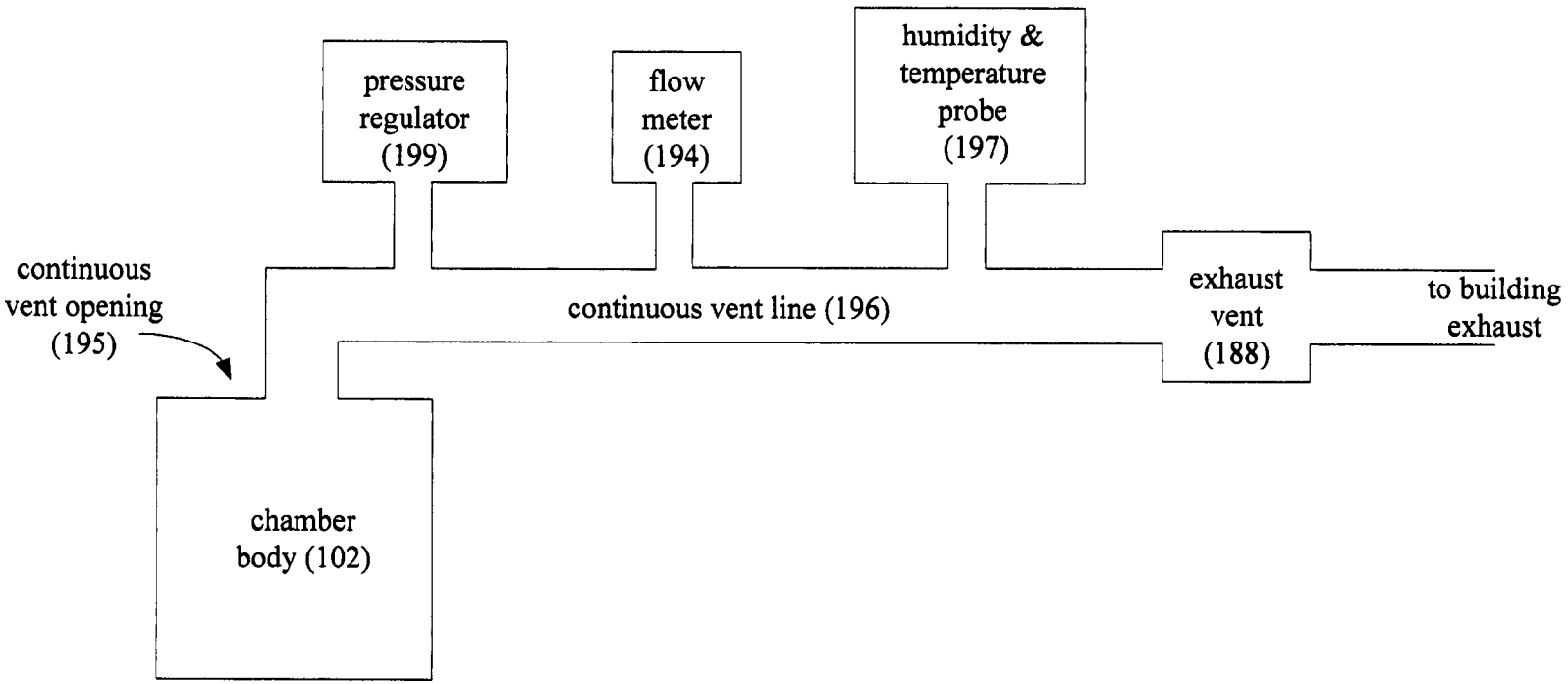
FIG. 21 is a block diagram of a continuous vent line used to release respirated gases from the hyperbaric chamber of FIG. 1, according to some embodiments.

FIG. 21 is a simplified block diagram of the continuous vent line 196, along with its associated components, according to some embodiments. The continuous vent line 196 is coupled to a continuous vent opening 195, located at the top of the chamber body 102. Because oxygen is heavier than other gases inside the chamber, the other gases, to some extent, float to the top, and so are able to exhaust out the continuous vent opening 195 into the continuous vent line 196. The continuous vent line 196 includes a pressure regulator 199, a flow meter 194, and a humidity and temperature probe 197, as shown. The operation of the continuous vent line 196 is described in the flow diagram of FIG. 22, below.

The continuous vent opening 195 remains open at all times. The flow meter 194 ensures that a relatively small amount of gas is released into the continuous vent line 196. In some embodiments, an oxygen content of between 95% and 98% is maintained during hyperbaric oxygen therapy.

Figure 22:
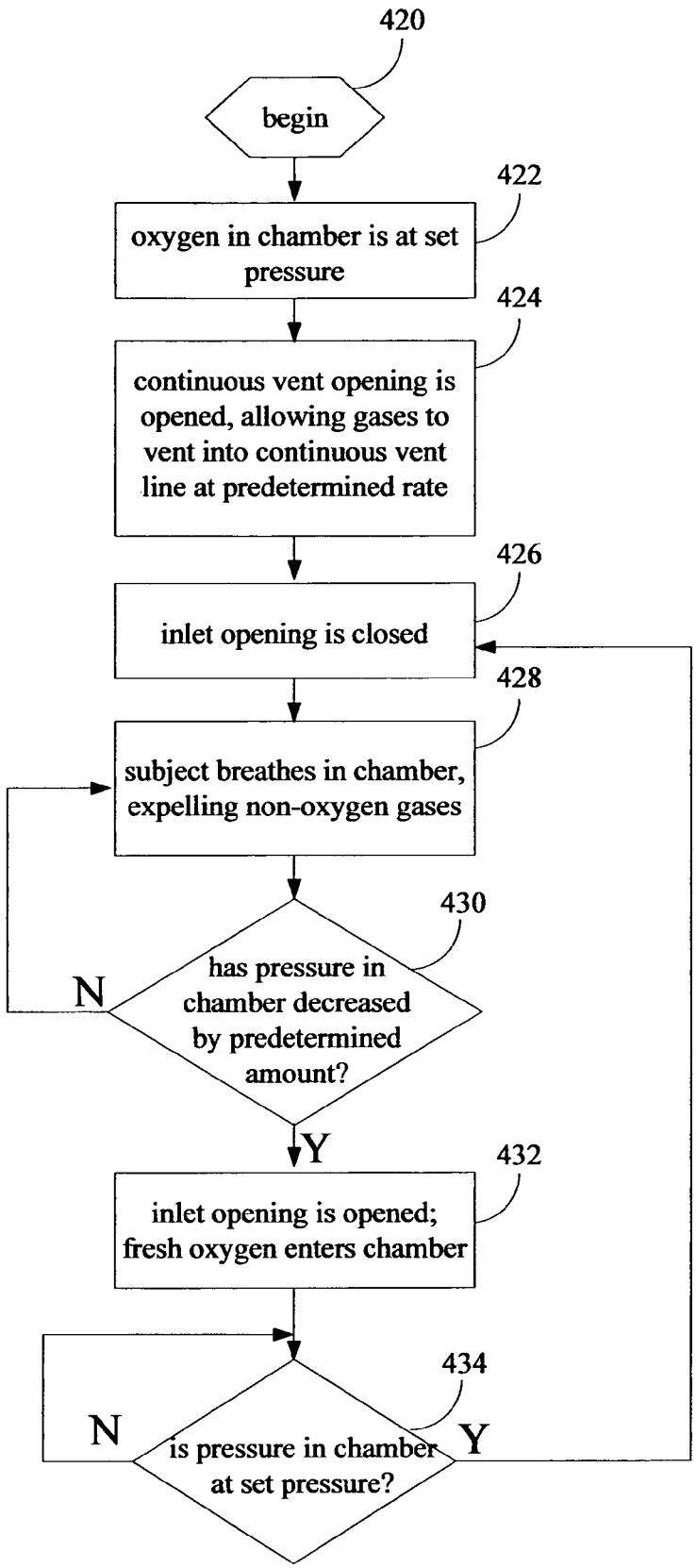
FIG. 22 is a flow diagram of the operation to maintain set pressure within the hyperbaric chamber of FIG. 1, according to some embodiments.

FIG. 22 is a flow diagram 420 of the operation of the hyperbaric system 100 in maintaining the set pressure within the chamber 102 during treatment, according to some embodiments. Once the chamber 102 is filled prior to treatment (see FIG. 16), the oxygen in the chamber is at the set pressure (block 422). The continuous vent opening 195 is opened (in some embodiments, the continuous vent opening 195 remains open at all times). The opening 195 allows gases to leave the chamber 102 at a predetermined rate (block 424). The flow meter 194 controls the rate of flow inside the continuous vent line 196 (FIG. 21). In some embodiments, the flow rate is approximately 200-600 standard cubic feet per hour (scfh). The inlet opening 116 is closed (426), so that new oxygen is not entering the chamber 102. The subject receiving hyperbaric oxygen therapy treatment inside the chamber is breathing, which produces gases other than oxygen (block 428).

The system automatically detects when the pressure in the chamber has decreased by a predetermined amount (block 430). In some embodiments, the predetermined amount is one pound. Until such time (the "no" prong of block 430), no change occurs. That is, the continuous vent is allowing a small amount of gas to leave the chamber, but no new oxygen is entering the chamber. The set pressure gauge 290 (FIG. 13) indicates when the change in pressure has exceeded a pound, at which point the inlet opening 116 is opened, allowing fresh oxygen to enter the chamber 102 (block 432). This continues until the chamber pressure again reaches the set pressure (the "yes" prong of block 434), at which point the inlet opening is closed again (block 426). The process repeats itself continuously, as shown in FIG. 22, until the exhaust flow mechanism 370 is initiated, at which point the inlet opening 116 is closed.

While the invention has been described with respect to a limited number of embodiments, those skilled in the art will appreciate numerous modifications and variations therefrom. It is intended that the appended claims cover all such modifications and variations as fall within the true spirit and scope of the invention.

I claim:

1. A hyperbaric system, comprising:

a chamber to receive oxygen at a predetermined high pressure, the chamber comprising a chamber body;

a davit door assembly comprising a door, a davit arm, the davit arm rotatably attached to an inside wall of the chamber body, the door being capable of moving against a door frame so as to form a seal against the door when the chamber body is pressurized;

a pair of thrust bearings, the thrust bearings being disposed inside the vertical portion of the davit arm, each thrust bearing comprising a top plate and a bottom plate, the top plate to move while the bottom plate is stationary, wherein the thrust bearings enable the davit arm to freely rotate along an arc, from a closed position against the door frame to a fully opened position against the wall of the chamber; and a pair of roller bearings, the roller bearings being disposed inside the vertical portion of the davit arm, each roller bearing being disposed upon a shaft such that, as the shaft rotates, balls inside each roller bearing turn against an outside surface of the roller bearings while an inside surface of each roller bearing remains stationary against the shaft, wherein the roller bearings enable the davit arm to rotate easily by keeping the main davit arm shaft from flexing or bending; and a control system, comprising:

an inlet supply line to transmit oxygen into the chamber body from an oxygen source, the davit door forming a seal against the door frame once the oxygen has reached a predetermined pressure;

a floor assembly comprising a main floor, the main floor comprising a pie-shaped rigid plate coated with a static dissipative polyurethane material, a bottom flathead disposed upon a skirt of the chamber, the flathead having a drain hole disposed in its center and a sub-floor disposed beneath the main floor, the sub-floor being disposed at a slight slope, wherein waste automatically moves toward the drain during hyperbaric oxygen therapy treatment; and a control interface to enable operation of the inlet supply line and an exhaust line;

wherein the chamber body is pressurized to a set pressure sufficient for hyperbaric oxygen therapy treatment when the inlet supply line transmits oxygen into the chamber body.

2. The hyperbaric system of claim 1, the chamber further comprising a dished head, a base plate, and a skirt, the chamber being disposed into the ground so that the base plate and skirt are beneath the ground, the chamber further comprising a door frame.

3. The hyperbaric system of claim 1, further comprising:

a floor assembly comprising;

a main floor, comprising a pie-shaped rigid plate coated with a static dissipative polyurethane material;

a bottom flathead disposed upon the skirt of the chamber, the flathead having a drain hole disposed in its center; and sub-floor disposed beneath the main floor, the sub-floor being disposed at a slight slope;

wherein waste automatically moves toward the drain during hyperbaric oxygen therapy treatment.

4. The hyperbaric system of claim 3, the floor assembly further comprising:

floor framing disposed between the main floor and the sub-floor, the floor framing providing structural support when an entity walks inside the chamber.

5. The hyperbaric system of claim 1, the control system further comprising:

an exhaust line to transmit gases out of the chamber body, the gases being transmitted at a predetermined exhaust rate.

6. The hyperbaric system of claim 5, the control system further comprising:

a microprocessor to time events occurring within the chamber.

7. The hyperbaric system of claim 1, the davit door assembly further comprising:

a davit arm support box welded to the inside wall of the chamber body;

a main davit arm shaft disposed through the davit arm support box, the main davit arm shaft enabling the davit arm to rotate in a an arc between the door frame and an inner wall of the chamber, wherein the arc is up to 160 degrees;

a spreader bar disposed above and parallel to the davit door, the spreader bar having a pair of first bolts disposed orthogonally though both the spreader bar and the davit door;

a swivel shaft disposed orthogonally through an end of the main davit arm, the swivel shaft being bolted through the spreader bar but not through the door, wherein the swivel shaft enables the door to revolve in a 360 degree circle.

8. The hyperbaric system of claim 7, wherein the pair of first bolts are used to adjust the level of the door.

9. The hyperbaric system of claim 7, further comprising:

a davit arm adjusting plate, the main davit arm shaft being disposed orthogonally through the davit arm adjusting plate, the davit arm adjusting plate having a plurality of second bolts, wherein the first bolts and the second bolts are adjusted to move the position of the door.

10. The hyperbaric system of claim 5, wherein the inlet supply line is connected to an inlet opening located at a bottom portion of the chamber body and the exhaust line is connected to an exhaust opening located at a top portion of the chamber body.

11. The hyperbaric system of claim 10, further comprising:

a continuous vent line connected to a continuous vent opening located at the dish head, wherein the continuous vent line transmits gases from the chamber at a first predetermined rate, the first predetermined rate being lower than the predetermined exhaust rate.

12. The hyperbaric system of claim 11, the inlet supply line further comprising a pressure regulator, to reduce the pressure of oxygen from the oxygen source before being received into the chamber body.

13. The hyperbaric system of claim 12, the exhaust line further comprising a pressure release valve, the pressure release valve breaks causing gases to release from the chamber at a second predetermined rate when the pressure inside the chamber body exceeds a predetermined maximum amount, wherein the hyperbaric system is inoperable once the pressure release valve breaks.

14. The hyperbaric system of claim 12, the exhaust line further comprising a ball valve, the ball valve being manually engaged, wherein the ball valve causes gases to release from the chamber immediately upon engagement.

15. The hyperbaric system of claim 9, the davit door assembly further comprising:

a pair of thrust bearings, the thrust bearings being disposed inside the vertical portion of the davit arm, wherein the thrust bearings enable the davit arm to support the weight of the door; and a pair of roller bearings, the roller bearings being disposed inside the vertical portion of the davit arm, wherein the roller bearings enable the davit arm to rotate.

16. A davit door assembly, comprising:

a davit arm support box welded to a vertically disposed surface;

a davit arm comprising a vertical portion and a horizontal portion, the horizontal portion being disposed against a middle of the vertical portion in a t-shaped arrangement;

a main davit arm shaft disposed through the davit arm support box and through the vertical portion of the davit arm, the main davit arm shaft enabling the davit arm to rotate; and a door coupled the davit arm, wherein the door is movable when the davit arm rotates.

17. The davit door assembly of claim 16, further comprising:

a spreader bar disposed above and parallel to the davit door, the spreader bar having a pair of first bolts disposed orthogonally through both the spreader bar and the davit door; and a swivel shaft disposed orthogonally through an end of the main davit arm, the swivel shaft being bolted through the spreader bar but not through the door, wherein the swivel shaft allows the door to revolve in a 360° circular fashion; wherein the pair of first bolts are adjusted to change a level of the door.

18. The davit door assembly of claim 17, further comprising:

a davit arm adjusting plate, the main davit arm shaft being disposed orthogonally through the davit arm adjusting plate, the davit arm adjusting plate having a plurality of second bolts, wherein the second bolts are adjusted to change the position of the davit arm in the davit arm support box.

19. The davit door assembly of claim 17, wherein the door weighs more than two thousand pounds and is movable using two fingers.

20. The davit door assembly of claim 18, further comprising:

a pair of thrust bearings, the thrust bearings being disposed inside the vertical portion of the davit arm, wherein the thrust bearings enable the davit arm to support the weight of the door; and a pair of roller bearings, the roller bearings being disposed inside the vertical portion of the davit arm, wherein the roller bearings enable the davit arm to rotate.

21. A hyperbaric oxygen chamber, comprising:

a chamber body to receive oxygen at a predetermined high pressure, the chamber body being large enough to allow ambulatory movement of a subject while inside the chamber body;

a floor assembly comprising a drain system, a portion of the floor assembly being slightly angled such that water or other liquids automatically gravitate toward the drain system, the drain system further comprising a drain cone to receive water into a drain pipe disposed below the chamber body, wherein waste from the subject automatically moves toward the drain system during hyperbaric oxygen therapy treatment;

a door to seal against a door frame when the chamber body is pressurized, wherein the door frame is part of the chamber body; and a control system comprising an inlet supply line to transmit oxygen into the chamber body from an oxygen source such that the chamber body is pressurized to a set pressure sufficient for hyperbaric oxygen therapy treatment;

a main davit arm shaft disposed through a davit arm support box and through a vertical portion of a davit arm, the main davit arm shaft enabling the davit arm to rotate, wherein the door coupled to the davit arm enables the door to seal against the door frame;

a pair of thrust bearings, the thrust bearings being disposed inside the vertical portion of the davit arm, each thrust bearing comprising a top plate and a bottom plate, the top plate to move while the bottom plate is stationary, wherein the thrust bearings enable the davit arm to freely rotate along an arc, from a closed position against the door frame to a fully opened position against the wall of the chamber; and a pair of roller bearings, the roller bearings being disposed inside the vertical portion of the davit arm, each roller bearing being disposed upon a shaft such that, as the shaft rotates, balls inside each roller bearing turn against an outside surface of the roller bearings while an inside surface of each roller bearing remains stationary against the shaft, wherein the roller bearings enable the davit arm to rotate easily by keeping the main davit arm shaft from flexing or bending.

22. The hyperbaric oxygen chamber of claim 21, the chamber further comprising a dished head, a base plate, and a skirt, the chamber being disposed into the ground so that the base plate and skirt are beneath the ground, wherein the subject moves freely within the chamber.

23. The hyperbaric oxygen chamber of claim 21, further comprising:

a floor assembly comprising a drain hole;

wherein waste from the subject automatically moves toward the drain hole during hyperbaric oxygen therapy treatment.

24. The hyperbaric oxygen chamber of claim 23, the floor assembly further comprising:

a main floor, comprising a pie-shaped rigid plate coated with a polyurethane material;

a bottom flathead disposed upon the skirt of the chamber, wherein the drain hole is disposed in the center of the flathead;

a sub-floor disposed at a slight slope beneath the main floor; and floor framing disposed between the main floor and the sub-floor, the floor framing providing structural support when the subject enters the chamber.

25. The hyperbaric oxygen chamber of claim 22, wherein the chamber body and dished head are approximately one-half inch thick and the door and door frame are approximately two inches thick.

26. The hyperbaric oxygen chamber of claim 22, wherein the chamber body, the dished head, the door, and the door frame comprise pressure vessel quality carbon steel material.

27. The hyperbaric oxygen chamber of claim 21, wherein the chamber body is large enough to allow ambulatory movement of a horse inside the chamber, enabling the horse to urinate and defecate within the chamber, and to drink water while in the chamber.

28. The hyperbaric oxygen chamber of claim 21, wherein the moving parts of the door are maintained using fluorocarbon lubricants so as to avoid a fire hazard.

* * * * *